US011603662B1

(12) United States Patent
Godfrey

(10) Patent No.: US 11,603,662 B1
(45) Date of Patent: Mar. 14, 2023

(54) CEILING GRID SYSTEM

(71) Applicant: Preston Godfrey, Westfield, MA (US)

(72) Inventor: Preston Godfrey, Westfield, MA (US)

( * ) Notice: Subject to any disclaimer, the term of this patent is extended or adjusted under 35 U.S.C. 154(b) by 0 days.

(21) Appl. No.: 17/516,610

(22) Filed: Nov. 1, 2021

(51) Int. Cl.
*E04B 9/06* (2006.01)
*E04B 9/24* (2006.01)

(52) U.S. Cl.
CPC ..... *E04B 9/06* (2013.01); *E04B 9/241* (2013.01)

(58) Field of Classification Search
CPC . E04B 9/06; E04B 9/241; E04B 9/127; E04B 9/122; E04B 9/068; E04B 9/003; E04B 9/247
See application file for complete search history.

(56) References Cited

U.S. PATENT DOCUMENTS 2,303,269 A * 11/1942 Goss ..... E04B 9/16 403/387
3,383,811 A * 5/1968 Ades ..... E04B 9/003 52/28
3,720,432 A * 3/1973 Chudler ..... E04B 9/003 292/220
4,175,281 A * 11/1979 Lonseth ..... F21S 8/02 248/320
2017/0130455 A1* 5/2017 Bergman ..... E04B 9/245
2018/0291622 A1* 10/2018 Li ..... E04B 9/068
2020/0217071 A1* 7/2020 Yeo ..... E04B 9/18
2020/0291634 A1* 9/2020 Lehane ..... E04B 9/127
2022/0275642 A1* 9/2022 Heesbeen ..... E04B 9/16

* cited by examiner

*Primary Examiner* — Gisele D Ford
(74) *Attorney, Agent, or Firm* — Richard Kosakowski

(57) ABSTRACT

A ceiling grid system as part of a suspended ceiling having a plurality of ceiling panels includes main runners and cross-runners oriented transverse to each other and forming a two-dimensional array having openings, each opening defining a position within the suspended ceiling in which a ceiling panel is disposed, the main runners and the cross-runners being configured to attach to each other and to be fixed in the horizontal plane in the physical space, each one of a plurality of panel support members is connected with a main runner or a cross-runner and is configured to support one of the ceiling panels, each panel support member is movable in a rotatable or linear manner with respect to the main runner or the cross-runner to facilitate the installation or removal of one of the ceiling panel with respect to its predetermined position within the suspended ceiling.

12 Claims, 18 Drawing Sheets

CEILING GRID SYSTEM

FIELD OF THE INVENTION

The subject matter disclosed herein relates in general to ceiling grid systems for use as part of suspended ceilings that are installed in rooms, and more specifically to such a ceiling grid system with movable components which allow for relatively easy access to individual ceiling panels thereby facilitating the quicker and easier installation and removal of the ceiling panels and with much less chance of causing damage to the panels.

BACKGROUND OF THE INVENTION

Known, prior art ceiling grid systems are part of overall suspended ceilings (aka "drop ceilings") which are commonly installed, for example, in rooms inside residences and commercial office spaces or in other physical spaces. These ceiling grid systems typically comprise a plurality of main runners along with a plurality of cross runners oriented perpendicular or transverse to the main runners. This arrangement of main runners and cross runners forms a two-dimensional grid or array that is horizontally disposed in a ceiling of a room. The main runners and cross runners are usually attached by, e.g., hanger clips, brackets, wires, etc. to the overhead ceiling members or substructure (e.g., ceiling/floor joists for the surface above in the room of the home or building) and extend vertically downward therefrom a predetermined distance. This "clearance" distance is kept as small as possible in order to maximize the vertical distance in the room between the floor of the room and the bottom of the suspended ceiling (i.e., the ceiling height or occupied space in the room).

Also, the main runners and cross runners are spaced apart such that they define rectilinear (e.g., square or rectangular) openings with uniform dimensions such as, for example, two feet by two feet, two feet by four feet, or other known standard dimensions. Ceiling panels are then placed within the openings. These main runners and cross runners are commonly made from a rigid material such as extruded aluminum, plastic or lighter gauge steel and typically have flanged surfaces which are disposed or extend horizontally at the edges of the defined openings. The flanged surfaces are generally fixed, and thus non-movable, and are configured to support and hold the outer edges of the individual ceiling panels or tiles in place such that the four outer peripheral edges of each ceiling panel rest on the corresponding upper surfaces of the flanges. Thus, a cross-sectional profile of a main runner or cross runner is generally in the shape of an upside down "T".

A primary problem with known ceiling grid systems is that because the flanged surfaces of the main runners and the cross runners are generally fixed and non-movable once the grid system has been installed, it becomes difficult for someone (especially a first time "do-it-yourself" person) to install or remove a ceiling panel at an opening in the grid system without damaging the ceiling panel. Specifically, because the outer peripheral edges of a ceiling panel typically rest on top of the upper surfaces of the flanges, the size of the opening defined by the main runners and the cross runners is somewhat smaller than the overall size of the ceiling panel. Also, physical objects such as light fixtures, air vents and ducts, sound speakers, electrical wiring, plumbing pipes, etc. are typically located within the plenum space at the upper portion of the room. It is generally desirable to conceal these physical objects in the plenum space using the suspended ceiling, while also allowing easy access to these objects when needed for, e.g., service or replacement. Thus, the location of these physical objects must be accounted for when initially installing the suspended ceiling in the room.

More importantly, oftentimes the person installing or removing the ceiling panels at the openings in the grid system is required to maneuver or angle the ceiling panel awkwardly to be able to position the panel within the opening so that the panel rests on the flanges, or to also remove the panel from the opening. This must be accomplished without allowing the ceiling panel to contact any of the aforementioned physical objects, all the while being done within the limited clearance distance in the plenum space between the upper ceiling/floor joists and the flanges of the runners. Further, because the ceiling panels are typically made from a lightweight and fragile material such as fiberboard, a portion of the panel material can easily break off or the surface of the ceiling panel facing the interior of the room can get scratched or marred during this installation or removal process, thereby damaging or ruining the ceiling panel and necessitating its replacement.

Therefore, what is needed is a ceiling grid system having a structure that allows for the relatively quick and easy installation and removal of the ceiling panels without damaging the panels.

BRIEF SUMMARY OF THE INVENTION

An object of embodiments of the present invention is to provide a ceiling grid system for a suspended ceiling in which the ceiling grid system requires less additional empty or free space in the plenum space above the ceiling grid system and below the upper structural elements such as ceiling or floor joists as compared to prior art ceiling grid systems.

Another object of embodiments of the present invention is to provide a ceiling grid system for a suspended ceiling which enables the placement of the overall suspended ceiling directly below structural elements such as ceiling or floor joists.

Yet another object of embodiments of the present invention is to provide a ceiling grid system for a suspended ceiling which effectively increases the vertical distance or occupied space in the room between the floor in the room and the bottom of the suspended ceiling.

Still another object of embodiments of the present invention is to provide a ceiling grid system for a suspended ceiling which allows for the relatively quick and easy installation and removal of the ceiling panels without damaging the panels.

Another object of embodiments of the present invention is to provide a ceiling grid system for a suspended ceiling which has flanges on four sides of an opening in the grid system to support the ceiling panels wherein the support flanges on a number of sides of an opening can be rotated or otherwise moved out of their ceiling panel support positions to allow an individual ceiling panel to be installed or removed entirely from below the suspended ceiling.

According to an embodiment of the present invention, a ceiling grid system for use as part of a suspended ceiling having a plurality of ceiling panels is configured to hold each one of the ceiling panels in a predetermined position within the suspended ceiling when the suspended ceiling is installed in a physical space such as a room. The ceiling grid system includes a plurality of main runners configured to attach to a support structure in the physical space, and a plurality of cross-runners oriented transverse to the plurality of main runners thereby forming a two-dimensional array having a plurality of openings and being disposed in a horizontal plane in the physical space, each one of the openings defining each one of the predetermined positions within the suspended ceiling in which a corresponding ceiling panel is disposed, the main runners and the cross-runners configured to attach to each other and to be fixed in the horizontal plane in the physical space. The ceiling grid system also includes a plurality of panel support members, each one of the panel support members connected with a predetermined one of the main runners or a predetermined one of the cross-runners, each one of the panel support members configured to support one of the ceiling panels. Each one of the panel support members is movable with respect to the predetermined one of the main runners or the predetermined one of the cross-runners to facilitate the installation or removal of one of the ceiling panels with respect to its predetermined position within the suspended ceiling.

BRIEF DESCRIPTION OF THE DRAWINGS

The subject matter, which is regarded as the disclosure herein of exemplary embodiments of the present invention, is particularly pointed out and distinctly claimed in the claims at the conclusion of this specification. The forgoing and other features and advantages of the present invention will become more apparent from the following detailed description taken in conjunction with the accompanying drawings in which:

DETAILED DESCRIPTION OF THE INVENTION

It should be understood that, throughout this patent application and specifically in the written description that follows and in the accompanying drawing figures, the terms "horizontal" and "vertical" refer to horizontal and vertical orientations, respectively, as would be viewed and understood by one of ordinary skill in the art, with reference to the typical horizontal placement or installation in a room of an overall suspended ceiling and the resulting horizontal and vertical orientations of its constituent components, such as a ceiling grid system and its associated components of embodiments of the present invention.

Figure 1:
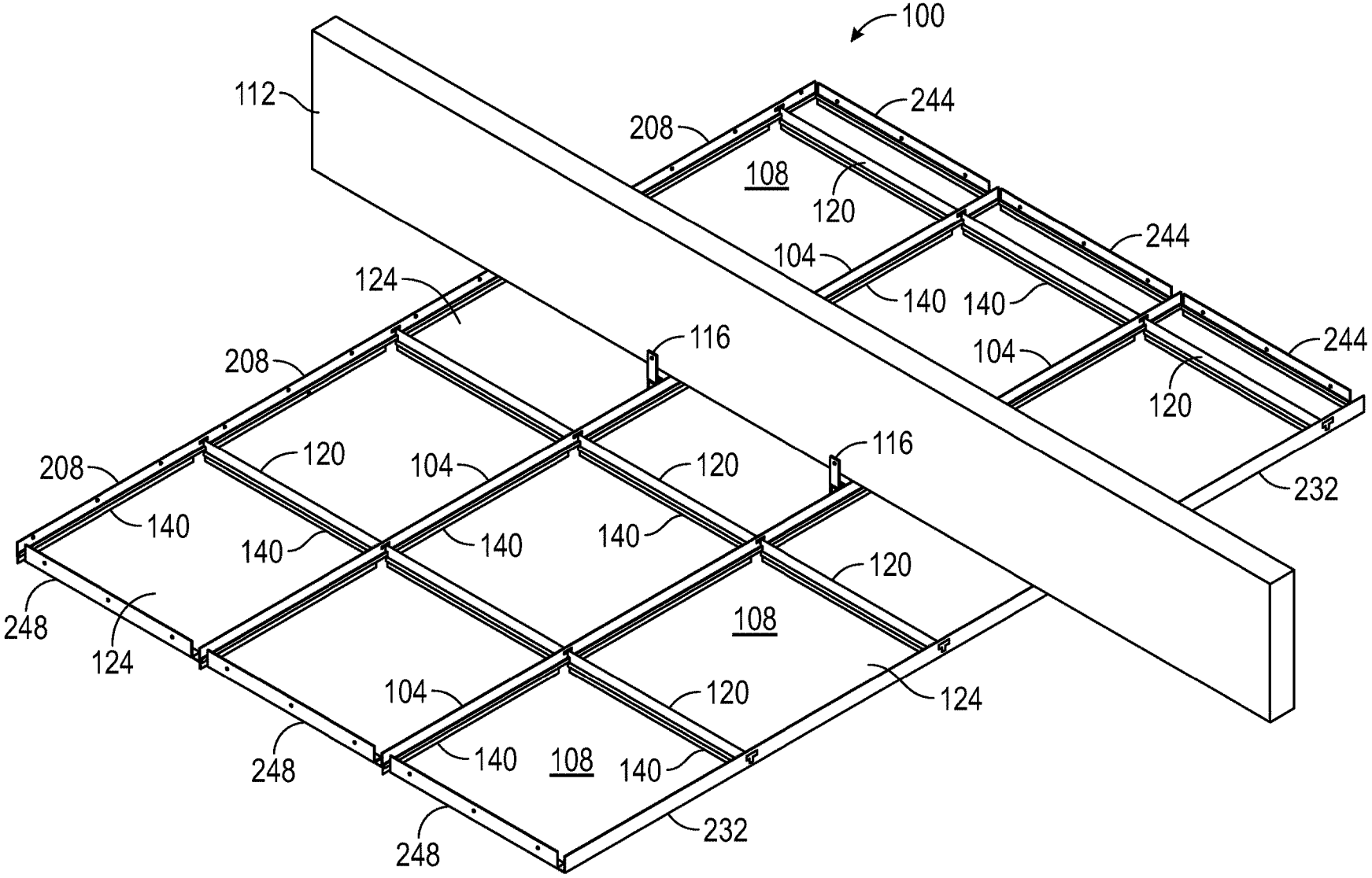
FIG. 1 is an isometric view of a ceiling grid system according to an embodiment of the present invention that is part of an overall suspended ceiling installed in a room.

Referring to FIG. 1, there illustrated is an isometric view of a ceiling grid system 100 according to an embodiment of the present invention. The ceiling grid system 100 is part of an overall suspended or drop ceiling that is commonly installed in a horizontal planar orientation in a room of a home or business such as in a commercial office space. These suspended ceilings are popular as they are an inexpensive and relatively quick and easy way for anyone (e.g., a "do-it-yourself" person) to add an aesthetically pleasing ceiling to a room such as in a basement of a home.

The ceiling grid system 100 includes a plurality of linear interior main runners 104 that are typically installed in a horizontal plane within the room, and parallel to each other at a spacing of the size of the square or rectangular ceiling panel 108 that is selected (e.g., two feet by two feet). In the embodiment shown in FIG. 1, two interior main runners 104 are illustrated; however, any number of interior main runners 104 may be utilized as necessary given the size of the room having the suspended ceiling installed and the teachings herein. The interior main runners 104 may be fastened in place to the structural members above (e.g., ceiling or floor joists 112) in a known manner by hanger clips, brackets, or wires 116.

Located between the interior main runners 104 are a plurality of linear cross-interior runners 120. The cross-interior runners 120 are disposed perpendicular or transverse to the interior main runners 104 and at a spacing of the size of the ceiling panel 108 selected (e.g., two feet by two feet). As such, and as seen in FIG. 1, the interior main runners 104 and the cross-interior runners 120 define the size and location of each one of a plurality of square-shaped or rectangular-shaped openings 124 within which a corresponding ceiling panel 108 is placed. Also, the interior main runners 104 and the cross-interior runners 120, together with various edge members described and illustrated in greater detail hereinafter, form a two-dimensional array or grid that defines the overall rectilinear shape and placement of the suspended ceiling within the room. In a typical suspended or drop ceiling, the interior main runners 104 are designed to carry most of the weight of the overall suspended ceiling, as compared to the cross-interior runners 120. In addition, each of the cross-interior runners 120 may be attached at each one of its two ends to the corresponding interior main runners 104 in a known manner, for example, by shaped tabs or protrusions inserted in correspondingly shaped pre-punched holes (e.g., T-shaped tabs and holes, vertical or horizontal tabs and holes, etc.) in the interior main runners 104, as described and illustrated in greater detail hereinafter. The specific type, shape or style of tab or protrusion and corresponding hole or receptacle is not a part of the broadest scope of embodiments of the present invention. Instead, any type of connection mechanism between the runners 104, 120 may be utilized in light of the teachings herein.

Figure 2:
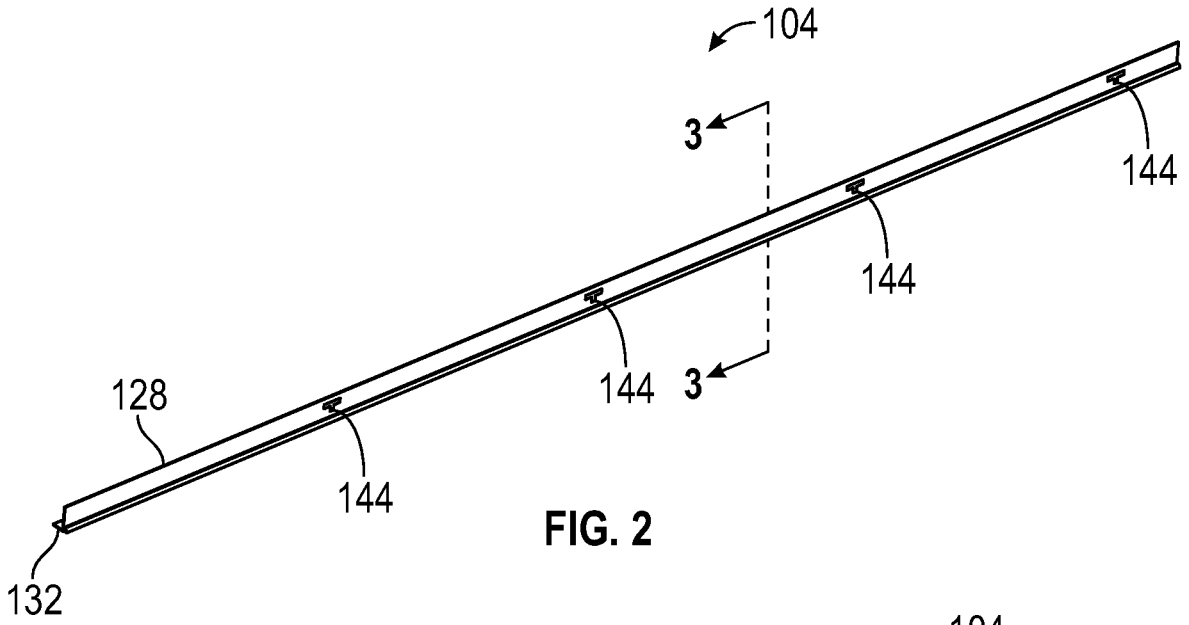
FIG. 2 is an isometric view of an interior main runner according to the embodiment of the present invention of FIG. 1.
Figure 3:
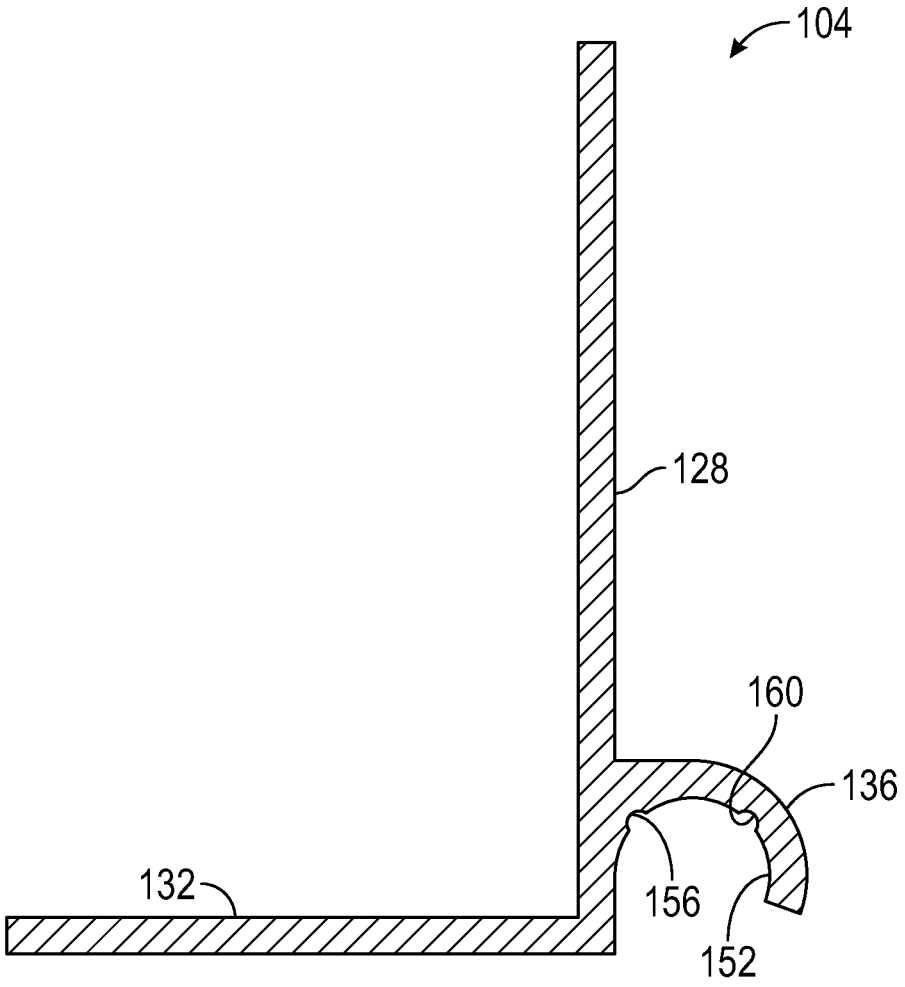
FIG. 3 is a cross-sectional view of the interior main runner of FIG. 2 taken along the lines 3-3 in FIG. 2.

Referring to FIGS. 2 and 3, according to an embodiment of the present invention, each of the interior main runners 104 has a cross-sectional profile that differs from the known upside down or inverted T-shaped profile of runners in the prior art. Specifically, the cross-sectional profile of each of the interior main runners 104 includes: (a) a vertical leg 128 that attaches to the ceiling or floor joists 112 using hanger clips, brackets, or wires 116 (as best seen in FIG. 1); (b) a fixed horizontal leg or flange 132 that supports one of the ceiling panels 108; and (c) a partially or less than fully circular (e.g., semicircular) or rounded shaped portion 136 that receives a separate rotatable panel support member 140 described and illustrated in greater detail hereinafter, with the panel support member 140 supporting another one of the ceiling panels 108 other than the ceiling panel 108 supported by the corresponding flange 132 of that same interior main runner 104. The fixed horizontal flange 132 of the interior main runner 104 may be referred to as the "fixed" side of the interior main runner 104, while the opposite side of the interior main runner 104 having the semicircular shaped portion 136 may be referred to as the "operable" side of the interior main runner 104.

The interior main runner 104 illustrated in FIG. 2 also includes a plurality of, e.g., T-shaped, pre-punched holes or slots 144 spaced apart at predetermined intervals and operable to receive the hook tabs 148 that are located at the ends of the cross-interior runners 120, as described hereinafter. However, it should be understood by one of ordinary skill in the art in light of the teachings herein that the various embodiments of the present invention described and illustrated herein are not limited to the tabs 148 being located on the cross-interior runners 120 and the holes 144 being located on the interior main runners 104. Instead, all or some of the tabs 148 may be located on the interior main runners 104 and all or some of the holes 144 may be located on the cross-interior runners 120 in various exemplary configurations.

As can be seen in FIG. 3, in an embodiment of the present invention, an inner surface 152 of the semicircular shaped portion 136 of the interior main runner 104 has two spaced apart depressions or grooves 156, 160 formed therein and disposed along the entire length of the interior main runner 104. These depressions or grooves 156, 160 may be circular or rounded or some other shape. As described and illustrated in greater detail hereinafter, the depressions or grooves 156, 160 create locking positions for the panel support member 140 in the horizontal and vertical positions.

Figure 4:
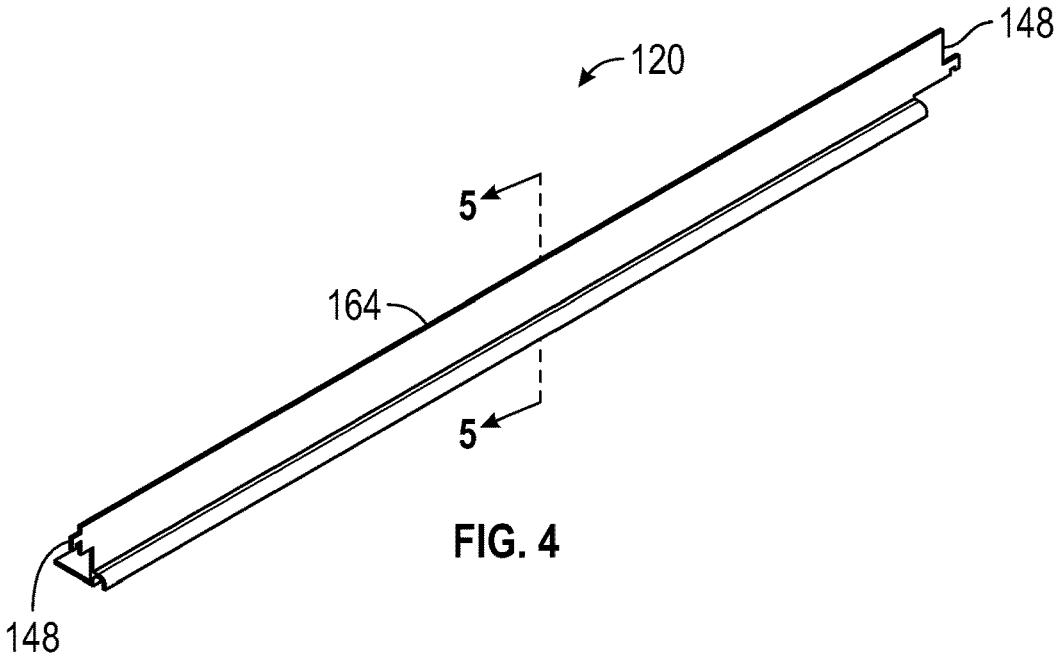
FIG. 4 is an isometric view of a cross-interior runner according to the embodiment of the present invention of FIG. 1.
Figure 5:
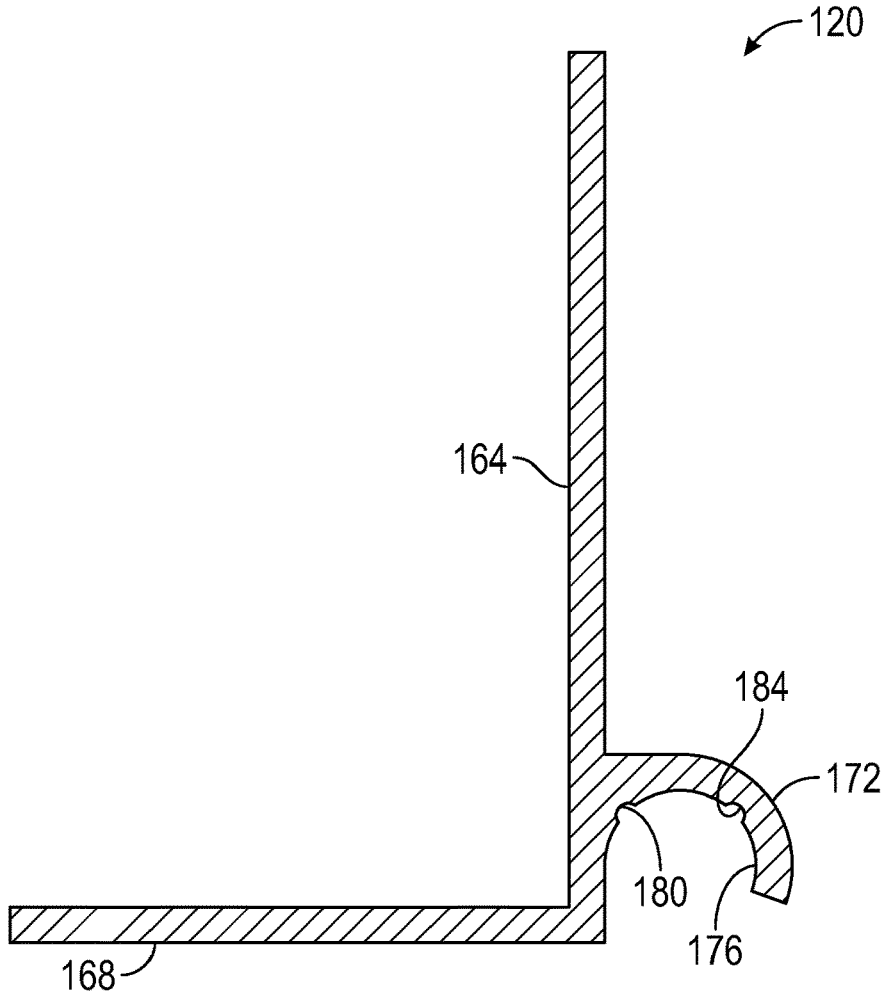
FIG. 5 is a cross-sectional view of the cross-interior runner of FIG. 4 taken along the lines 5-5 in FIG. 4.

Referring to FIGS. 4 and 5, according to an embodiment of the present invention, each of the cross-interior runners 120 has a cross-sectional profile that is similar to that of the interior main runner 104, as described hereinabove and illustrated in FIGS. 2 and 3. Specifically, the cross-sectional profile of each of the cross-interior runners 120 includes: (a) a vertical leg 164; (b) a fixed horizontal leg or flange 168 that supports one of the ceiling panels 108; and (c) a partially or less than fully circular (e.g., semicircular) or rounded shaped portion 172 that receives the separate rotatable panel support member 140 described and illustrated in greater detail hereinafter, and which supports another one of the ceiling panels 108 other than the ceiling panel 108 supported by the corresponding flange 168 of that same cross-interior runner 120. The fixed horizontal leg or flange 168 of the cross-interior runner 120 may be referred to as the "fixed" side of the cross-interior runner 120, while the opposite side of the cross-interior runner 120 having the semicircular shaped portion 172 may be referred to as the "operable" side of the cross-interior runner 120. The cross-interior runner 120 illustrated in FIG. 4 also includes the hook tab 148 at each end that is inserted into the corresponding one of the T-shaped pre-punched holes 144 within the interior main runner 104.

Similar to the interior main runner 104 illustrated in FIGS. 2 and 3, in an embodiment of the present invention, an inner surface 176 of the semicircular shaped portion 172 of the cross-interior runner 120 has two spaced apart depressions or grooves 180, 184 formed therein and disposed along the entire length of the cross-interior runner 120. These depressions or grooves 180, 184 may be circular or rounded or some other shape. As described and illustrated in greater detail hereinafter, the depressions or grooves 180, 184 create locking positions for the panel support member 140 in the horizontal and vertical positions.

As seen in FIG. 1, the placement of the cross-interior runners 120 between the interior main runners 104 results in the fixed horizontal leg or flange 168 of the cross-interior runner 120 and the fixed horizontal leg or flange 132 of the interior main runner 104 being adjacent and at a right angle to each other. Also, the placement of the cross-interior runners 120 between the interior main runners 104 results in the semicircular shaped portion 172 of the cross-interior runner 120 and the semicircular shaped portion 136 of the interior main runner 104 being adjacent and at a right angle to each other. The significance of these relationships is described and illustrated in greater detail hereinafter. Also, the configuration of the tabs 148 on the cross-interior runners 120 paired with the holes 144 in the interior main runners 104 allows for the assembly of the ceiling grid system 100 in the correct orientation.

Figure 6:
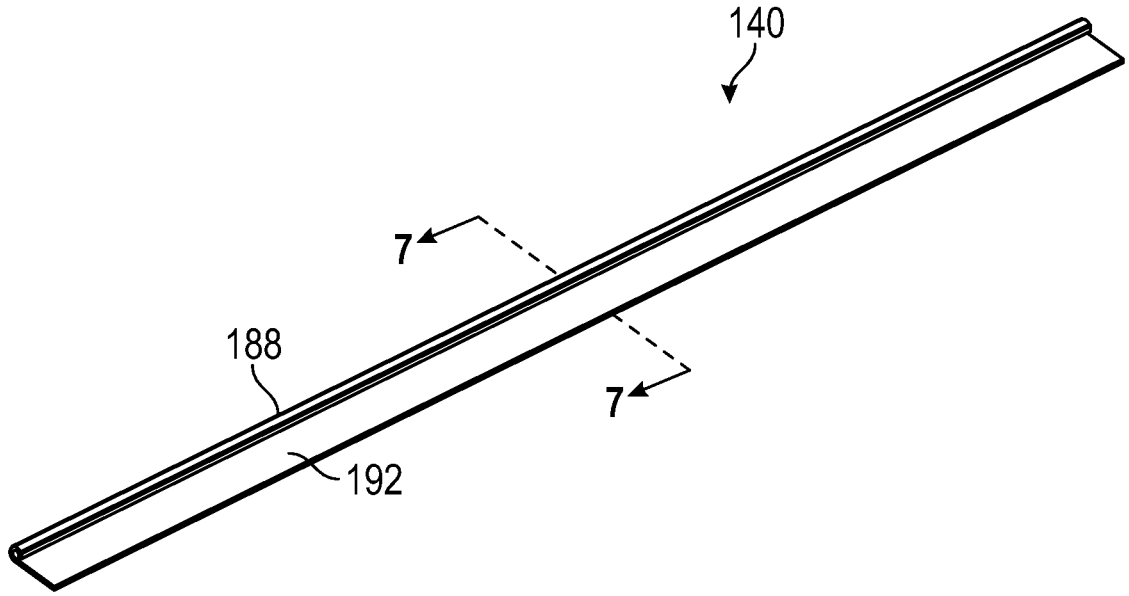
FIG. 6 is an isometric view of a panel support member according to the embodiment of the present invention of FIG. 1.
Figure 7:
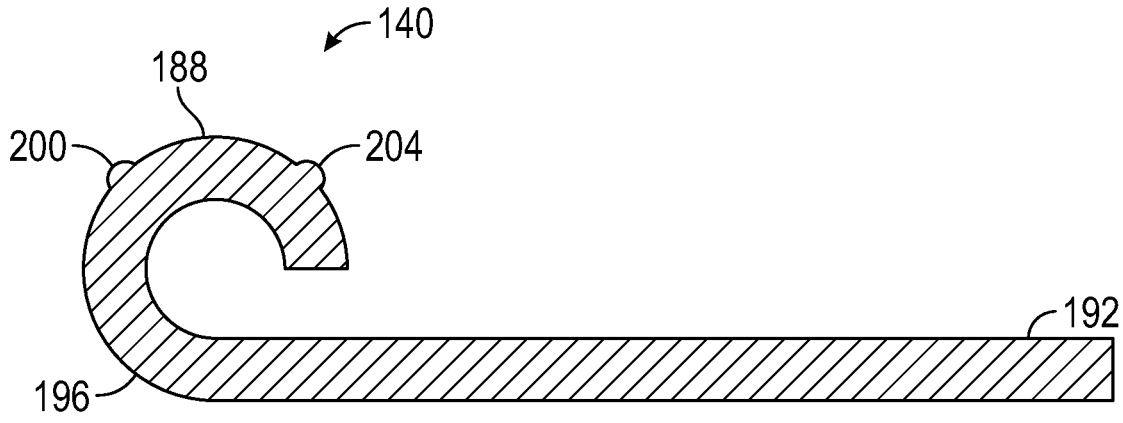
FIG. 7 is a cross-sectional view of the panel support member of FIG. 6 taken along the lines 7-7 in FIG. 6.

Referring to FIGS. 6 and 7, there illustrated is an exemplary embodiment of a panel support member 140. The panel support member 140 may have a length that equals a portion of the length of the interior main runner 104 and a portion of the length of the cross-interior runner 120. The length of a particular panel support member 140 depends in part on the size of the opening 124, which itself depends on the size of the ceiling panel 108 selected. The length of a particular panel support member 140 also depends in part on any physical size constraints imposed when the interior main runners 104 connect with the cross-interior runners 120 (e.g., in corners where these runners 104, 120 are connected). As seen in FIG. 7, the panel support member 140 has a cross-sectional profile that includes a partially or fully circular (e.g., semicircular) or rounded shaped portion 188 at one end. The other end of the panel support member 140 has a horizontal flange 192 that is used to support a ceiling panel 108, as described and illustrated in greater detail hereinafter.

An outer surface 196 of the semicircular shaped portion 188 of the panel support member 140 has a pair of spaced apart raised protrusions or ridges 200, 204 formed therein and disposed along the entire length of the panel support member 140. The raised protrusions or ridges 200, 204 are sized, shaped and located to fit or nest snugly within the two depressions or grooves 156, 160 formed in the interior main runner 104 (FIG. 3), and the two depressions or grooves 180, 184 formed in the cross-interior runner 120 (FIG. 5). Also, the size of the diameter of the semicircular shaped portion 136, 172 of both the inner surface 152 of the interior main runner 104 and of the inner surface 176 of the cross-interior runner 120 may be slightly larger than that of the outer surface 196 of the semicircular shaped portion 188 of the panel support member 140. This facilitates the proper receiving and operation of the panel support member 140 therewithin.

When nested as described and illustrated in greater detail hereinafter, the interlocking grooves 156, 160, 180, 184 and ridges 200, 204 are operable to keep the panel support member 140 locked or fixed in one of two different positions with respect to either the interior main runner 104 or the cross-interior runner 120. A first position is a horizontal position in which the horizontal flange 192 of the panel support member 140 supports one of the ceiling panels 108 within one of the openings 124 in the ceiling grid system 100. Note that in this horizontal position, the horizontal flange 192 of the panel support member 140 is located in the same horizontal plane as that of both the fixed horizontal flange 132 of the interior main runner 104 and the fixed horizontal flange 168 of the cross-interior runner 120. This allows for the proper horizontal leveling of the ceiling panels 108 within the corresponding openings 124. Also, this proper horizontal positioning of the horizontal flange 192 of the panel support member 140 is achieved by the placement of the semicircular shaped portion 136 on the interior main runner 104 and of the placement of the semicircular shaped portion 172 on the cross-interior runner 120.

A second position is the horizontal flange 192 being in a downward vertical position such that the horizontal flange 192 does not support the ceiling panel 108. Instead, this downward vertical position allows for the relatively quick and easy installation or removal of the ceiling panel 108 from below the corresponding opening 124 in the ceiling grid system 100.

Thus, as can be seen from the foregoing, the ceiling grid system 100 of embodiments of the present invention allows for the installation or removal of the ceiling panel 108 from below the opening 124 in the ceiling grid system 100. This is in contrast to someone being required to install or remove the ceiling panel 108 from above the opening 124, as is well known in prior art ceiling grid systems and as discussed hereinbefore in the "BACKGROUND OF THE INVENTION" section. Therefore, the ceiling grid system 100 of embodiments of the present invention represents a number of technical advantages and also eliminates a number of the aforementioned problems with prior art ceiling grid systems.

Figure 8:
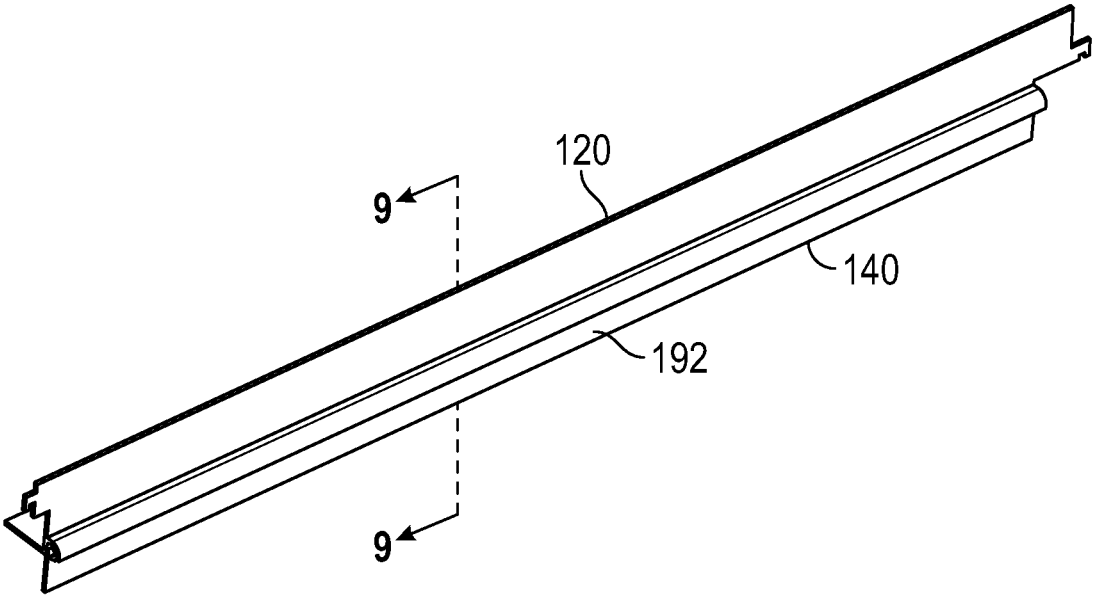
FIG. 8 is an isometric view of the cross-interior runner of FIG. 4 connected with the panel support member of FIG. 6 in an open position.
Figure 9:
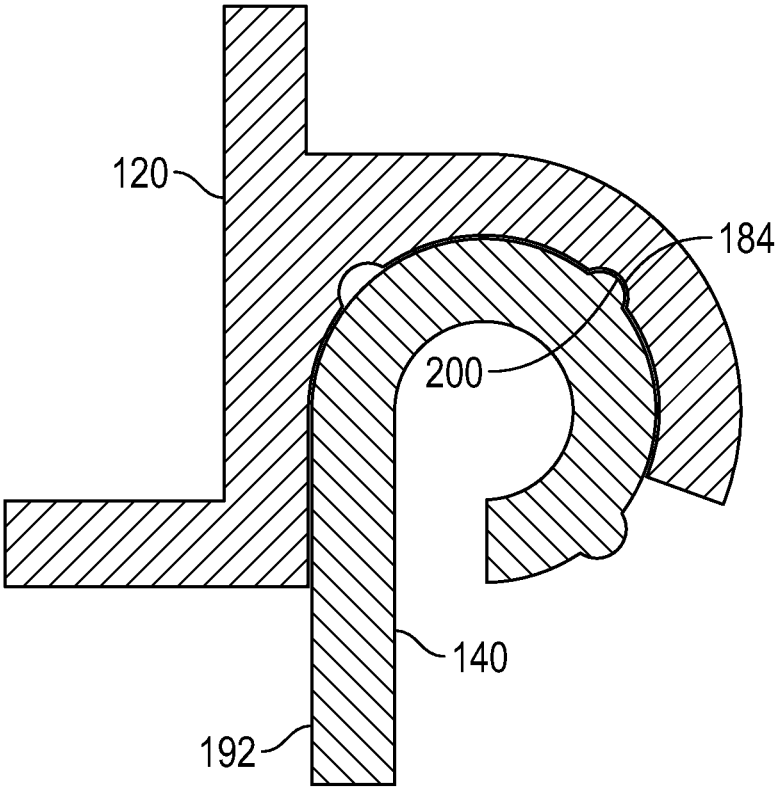
FIG. 9 is a cross-sectional view of the cross-interior runner of FIG. 4 connected with the panel support member of FIG. 6 in an open position, as shown in FIG. 8 and taken along the lines 9-9 in FIG. 8.
Figure 10:
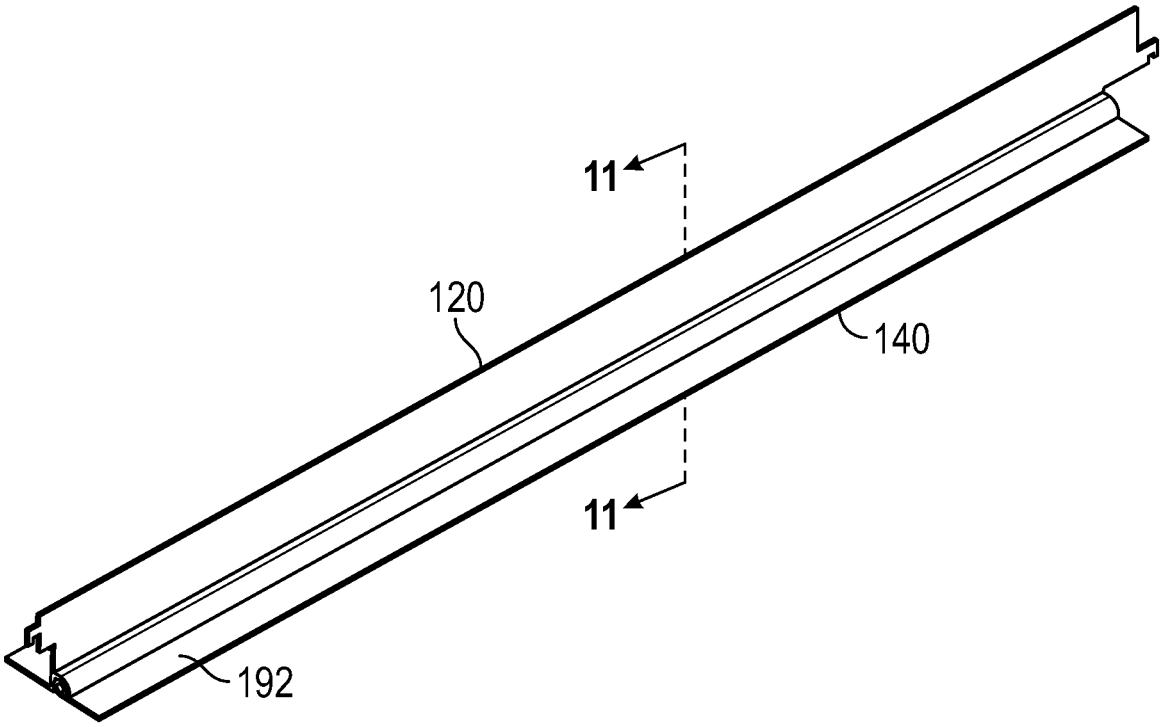
FIG. 10 is an isometric view of the cross-interior runner of FIG. 4 connected with the panel support member of FIG. 6 in a closed position.
Figure 11:
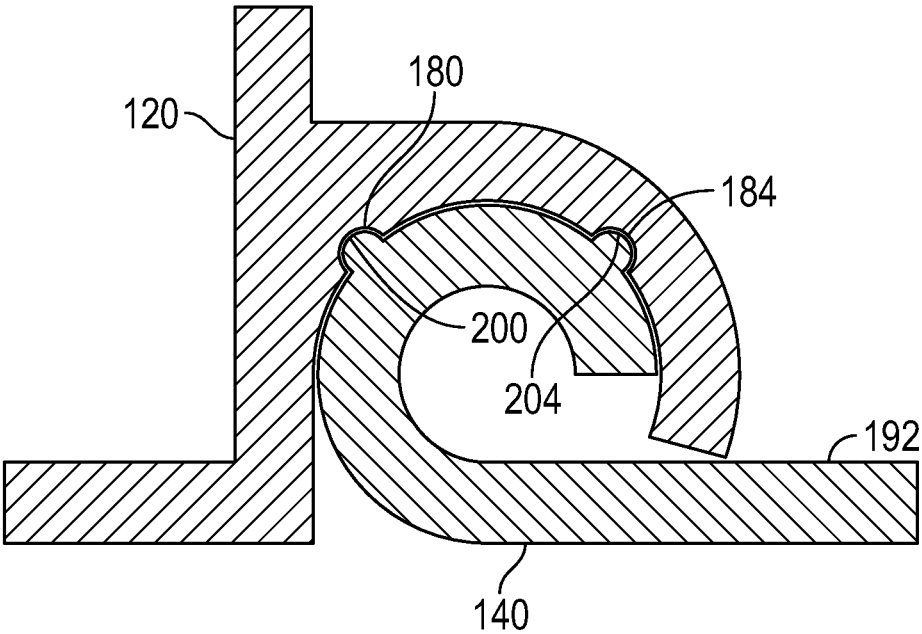
FIG. 11 is a cross-sectional view of the cross-interior runner of FIG. 4 connected with the panel support member of FIG. 6 in a closed position, as shown in FIG. 10 and taken along the lines 11-11 in FIG. 10.

Referring to FIGS. 8 and 9, there illustrated is an isometric view and a cross-sectional view, respectively, of a cross-interior runner 120 connected with a panel support member 140 in an assembly and with the panel support member 140 in an open position (i.e., with the horizontal flange 192 in the downward vertical "ceiling panel non-support" position). Referring also to FIGS. 10 and 11, there illustrated is an isometric view and a cross-sectional view, respectively, of the cross-interior runner 120 connected with the panel support member 140 and with the panel support member 140 in a closed position (i.e., with the horizontal flange 192 in the horizontal "ceiling panel support" position).

The panel support member 140 can be easily rotated between the open position of FIGS. 8 and 9 and the closed position of FIGS. 10 and 11. As shown in FIG. 9, when in the open position, only one protrusion or ridge 200 of the panel support member 140 nests within the corresponding depression or groove 184 of the cross-interior runner 120. In contrast, as shown in FIG. 11, when in the closed position, both protrusions or ridges 200, 204 of the panel support member 140 nest within the corresponding depressions or grooves 180, 184 of the cross-interior runner 120. Having both protrusions or ridges 200, 204 nest within the two depressions or grooves 180, 184 provides for sufficient interlocking of the cross-interior runner 120 with the panel support member 140 to thereby ensure the ability of the panel support member 140 to support the ceiling panel 108. It should also be understood that utilizing two depressions or grooves 180, 184 and two protrusions or ridges 200, 204 is purely exemplary. Instead, any number of depressions or grooves 180, 184 and protrusions or ridges 200, 204 may be utilized in light of the teachings herein.

It should be understood by one of ordinary skill in the art that this disclosure and illustration of the interaction and operation of a panel support member 140 with a cross-interior runner 120 is equally applicable to the interaction and operation of a panel support member 140 with an interior main runner 104. This is because, as described hereinabove and illustrated in FIGS. 2 and 3, the interior main runner 104 has a similar semicircular shaped portion 136 that is designed to interact with a panel support member 140 in the same manner as that of the cross-interior runner 120.

Referring to FIG. 1, the location of both the interior main runners 104 and the cross-interior runners 120 within the ceiling grid system 100 of embodiments of the present invention is such that, within any one of the openings 124 of the ceiling grid system 100, an operable side of an interior main runner 104 is adjacent to and at a right angle to an operable side of a cross-interior runner 120, and is also opposite to or across from a fixed side of another interior main runner 104 (or of an edge angle runner 232 described and illustrated in more detail hereinafter). It also follows that the operable side of the cross-interior runner 120 within that same opening 124 is opposite to or across from the fixed side of another cross-interior runner 120 (or of a cross-angle end runner 248 described and illustrated in more detail hereinafter). Thus, in the embodiment of the present invention of FIG. 1, two operable sides and two fixed sides are located within any one of the four-sided openings 124.

A result of this ceiling grid system 100 configuration of interior main runners 104 and cross-interior runners 120 is that in any one of the openings 124 within the ceiling grid system 100 of embodiments of the present invention, two adjacent operable sides of an interior man runner 104 and of a cross-interior runner 120 can be rotated to the downward vertical position. This allows someone to insert or install a ceiling panel 108 into the opening 124 from below the ceiling grid system 100. As such, the ceiling panel 108 rests on the two adjacent fixed horizontal flanges 132, 168 of the interior main runner 104 and of the cross-interior runner 120, respectively. Then the panel support members 140 can be rotated to the horizontal position to properly support the ceiling panel 108 on the two operable sides of the interior main runner 104 and of the cross-interior runner 120. This can be done without having to awkwardly angle or maneuver the ceiling panel 108 from within the plenum space above the opening 124 and possibly breaking a portion of or damaging the ceiling panel 108, as is possible with prior art ceiling grid systems discussed hereinabove.

Embodiments of the ceiling grid system 100 of the present invention described hereinabove and illustrated in FIGS. 1-11 disclose a rectilinear ceiling grid system 100 having a plurality of four-sided square or rectangular openings 124, with each opening 124 accommodating a ceiling panel 108. Further, each opening 124 has four sides, with two of the sides being operable and the other two sides being fixed. However, it should be understood that the broadest scope of the present invention is not limited as such. Instead, other embodiments of ceiling grid systems 100 that are contemplated by the present invention include those that have only one operable side and three fixed sides, or that have three or four operable sides and one or zero fixed sides, respectively. Also, in an embodiment with two operable sides and two fixed sides, the two operable sides do not necessarily need to be adjacent to each other. Instead, the two operable sides may be opposite each other such that the two fixed sides are opposite each other. It suffices for the broadest scope of the present invention that a ceiling grid system 100 has at least one operable side to allow for relatively quicker and easier access by someone to install or remove a ceiling panel from an opening on the ceiling grid system.

Further, embodiments of the ceiling grid system 100 of the present invention described hereinabove and illustrated in FIGS. 1-11 disclose a rectilinear ceiling grid system 100 having a plurality of interior main runners 104 and a plurality of cross-interior runners 120. However, as can be seen in FIG. 1, the interior main runners 104 and the cross-interior runners 120 are located within the interior portion of the ceiling grid system 100 and are typically not located at or along the peripheral edges or walls of a room in which the suspension ceiling is installed. Thus, the ceiling grid system 100 of embodiments of the present invention needs to account for these peripheral edges or walls of the room. This is accomplished by several additional members or components of the ceiling grid system 100 of embodiments of the present invention, as described and illustrated in greater detail hereinafter.

Figure 12:
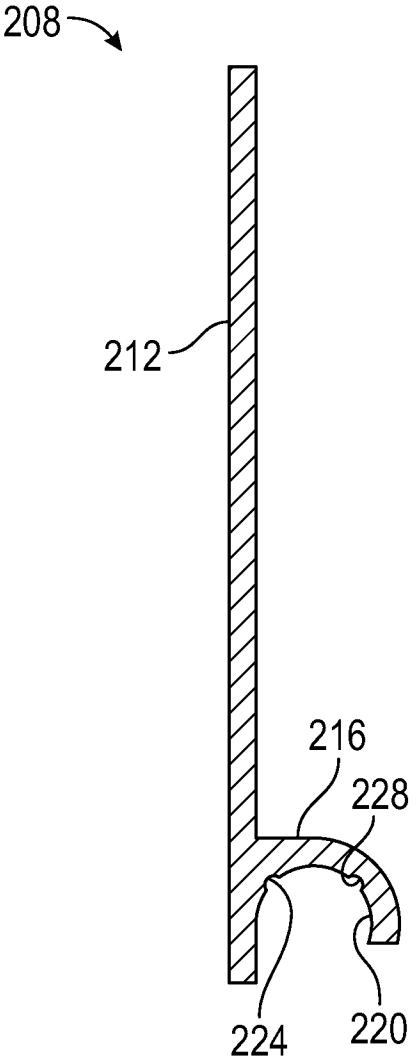
FIG. 12 is a cross-sectional view of an edge main runner according to the embodiment of the present invention of FIG. 1.

Referring to FIG. 12, there illustrated is a cross-sectional view of an edge main runner 208, which is similar to the interior main runner 104 except that the edge main runner 208 does not include the fixed horizontal flange 132. Specifically, the cross-sectional profile of the edge main runner 208 includes: (a) a vertical leg 212 that attaches to the wall or other surface in a room using, e.g., screws, nails, or other types of fasteners; and (b) a partially or less than fully circular (e.g., semicircular) or rounded shaped portion 216 that receives the separate rotatable panel support member 140. The semicircular shaped portion 216 is the operable side of the edge main runner 208 and interacts with a panel support member 140 to support a ceiling panel 108. Due to its positioning at the outer edges of a room (FIG. 1), the edge main runner 208 is intended to support only one ceiling panel 108 at its only one side—the operable side; hence there is no fixed horizontal flange 132 and thus no fixed side opposite the semicircular shaped portion 216 within the edge main runner 208, as compared to the interior main runner 104.

As can be seen in FIG. 12, and similar to the interior main runner 104, in an embodiment of the present invention, an inner surface 220 of the semicircular shaped portion 216 of the edge main runner 208 has two spaced apart depressions or grooves 224, 228 formed therein and disposed along the entire length of the edge main runner 208. These depressions or grooves 224, 228 may be circular or rounded or some other shape. The depressions or grooves 224, 228 create locking positions for the panel support member 140 in the horizontal and vertical positions, similar to the interior main runner 104.

Referring also to FIG. 1, the one or more edge main runners 208 are located within the ceiling grid system 100 in embodiments of the present invention at a position that is parallel the interior main runners 104 and where there is a need to support a ceiling panel 108 with the operable side of the edge main runner 208. Further, the edge main runner 208 is installed so that the panel support member 140, when installed within the semicircular shaped portion 216 of the edge main runner 208, is in the same horizontal plane as the fixed horizontal flange 132 of the interior main runners 104 and the fixed horizontal flange 168 of the cross-interior runners 120.

Figure 13:
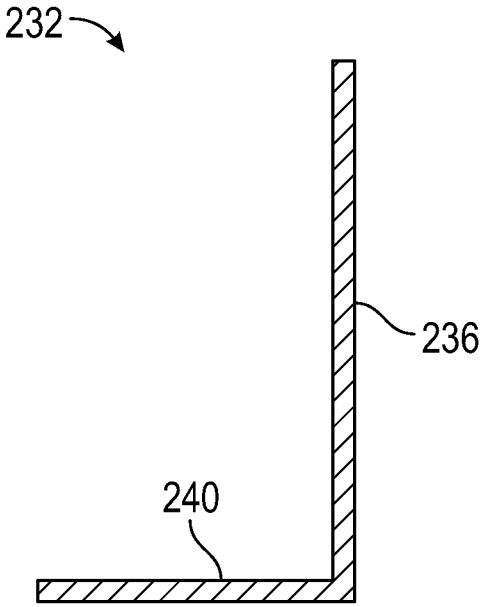
FIG. 13 is a cross-sectional view of an edge angle runner according to the embodiment of the present invention of FIG. 1.

Referring to FIG. 13, there illustrated is a cross-sectional view of an edge angle runner 232, which is similar to the interior main runner 104 except that the edge angle runner 232 does not include the semicircular shaped portion 136. Specifically, the cross-sectional profile of the edge main runner 232 includes: (a) a vertical leg 236 that attaches to the wall or other surface in a room using, e.g., screws, nails, or other types of fasteners; and (b) a fixed horizontal leg or flange 240 which is the fixed side of the edge angle runner 232 and supports a ceiling panel 108. Due to its positioning at the outer edges or walls of a room (FIG. 1), the edge angle runner 232 is intended to support only one ceiling panel 108 at its only one side—the fixed side; hence there is no semicircular shaped portion 136 and thus no operable side opposite the flange 240 within the edge angle runner 232, as compared to the interior main runner 104.

Referring also to FIG. 1, the one or more edge angle runners 232 are located within the ceiling grid system 100 in embodiments of the present invention at a position that is parallel the interior main runners 104 and where there is a need to support a ceiling panel 108 with the fixed side of the edge angle runner 208. The edge angle runner 232 is typically located on a wall that is parallel to and opposite a wall that the edge main runner 208 is mounted to. Further, the edge angle runner 232 is installed such that the fixed horizontal leg or flange 240 of the edge angle runner 232 is in the same horizontal plane as the fixed horizontal flange 132 of the interior main runners 104 and the fixed horizontal flange 168 of the cross-interior runners 120.

Similar to the edge main runner 208 and the edge angle runner 232 both being attached to opposite parallel walls in a room, a cross-end runner 244 and a cross-angle end runner 248 are provided (FIG. 1). The cross-end runner 244 has a cross-sectional profile similar to that of edge main runner 208, as shown in FIG. 12. Also, the cross-angle end runner 248 has a cross-sectional profile similar to that of edge angle runner 232, as shown in FIG. 13.

Referring to FIG. 1, the one or more cross-end runners 244 are located within the ceiling grid system 100 in embodiments of the present invention at a position that is parallel to the cross-interior runners 104 and where there is a need to support a ceiling panel 108 with the operable side of the cross-end runner 244. Further, the cross-end runner 244 is installed so that the panel support member 240, when installed within the semicircular shaped portion 216 of the cross-end runner 244, is in the same horizontal plane as the fixed horizontal flange 132 of the interior main runners 104 and the fixed horizontal flange 168 of the cross-interior runners 120.

Also, the one or more cross-angle end runners 248 are located within the ceiling grid system 100 in embodiments of the present invention at a position that is parallel to the cross-interior runners 120 and where there is a need to support a ceiling panel 108 with the fixed side of the cross-angle end runner 248. The cross-angle end runner 248 is typically located on a wall that is parallel to and opposite a wall that the cross-end runner 244 is mounted to. Further, the cross-angle end runner 248 is installed such that the fixed horizontal leg or flange 240 of the cross-angle end runner 232 is in the same horizontal plane as the fixed horizontal flange 132 of the interior main runners 104 and the fixed horizontal flange 168 of the cross-interior runners 120.

Embodiments of the ceiling grid system 100 of the present invention described hereinabove and illustrated in FIGS. 1-11 disclose an interior main runner 104 and a cross-interior runner 120 that each has a semicircular shaped portion 136, 172 which interfaces with a corresponding semicircular shaped portion 188 of a panel support member 140. As disclosed herein, these semicircular shaped portions 136, 172, 188 facilitate the rotation of the panel support member 140 with respect to the interior main runner 104 and the cross-interior runner 120 to thereby position the panel support member 140 to either support a ceiling panel 108 within an opening 108 of the ceiling grid system 100 or to facilitate its installation or removal therefrom.

However, it should be understood that the broadest scope of the present invention is not limited as such. Instead, other embodiments of ceiling grid systems 100 according to the present invention include those in which the panel support member 140 is movable not in a rotational manner with respect to the interior main runner 104 and the cross-interior runner 120, but instead the panel support member 140 is movable essentially in a linear, up-and-down or vertical manner with respect to the horizontal plane of the interior main runner 104 and the cross-interior runner 120. Exemplary embodiments of such linear vertical movement of the various members are now described and illustrated.

Figure 14:
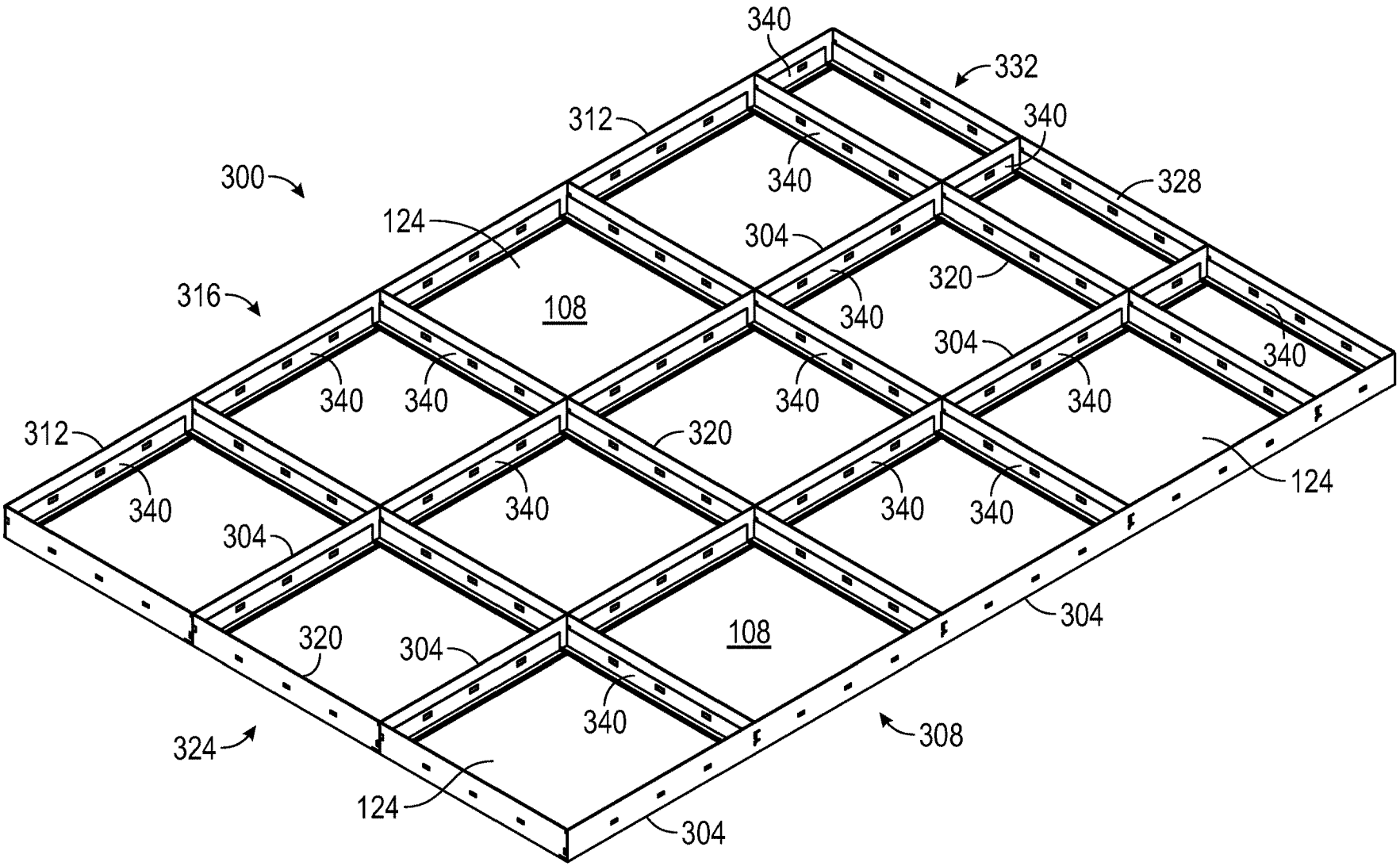
FIG. 14 is an isometric view of a ceiling grid system according to another embodiment of the present invention.

Referring to FIG. 14, there illustrated is an isometric view of a ceiling grid system 300 according to another embodiment of the present invention. The ceiling grid system 300 is similar in many structural and functional aspects to the embodiment of the ceiling grid system 100 described hereinabove and illustrated in FIGS. 1-13. The primary differences between the ceiling grid systems 100, 300 relate to the structure and function of the main runners, cross-runners, and panel support members.

Specifically, the ceiling grid system 300 of FIG. 14 includes a plurality of main runners 304 oriented parallel to each other. The majority of the main runners 304 are located within the interior of the ceiling grid system 300, and at least one main runner 304 is located along one peripheral edge or wall 308 of the room. The ceiling grid system 300 of FIG. 14 also includes at least one edge main runner 312, which is oriented parallel to the main runners 304. The edge main runner 312 is located along a peripheral edge or wall 316 of the room that is parallel to and opposite the wall 308 having the at least one main runner 304 attached thereto.

The ceiling grid system 300 of FIG. 14 also includes a plurality of cross-interior flanged runners 320 oriented parallel to each other and perpendicular to the main runners 304 and the edge main runner 312. The majority of the cross-interior flanged runners 320 are located within the interior of the ceiling grid system 300. At least one cross-interior flanged runner 320 is located along one peripheral edge or wall 324 of the room that is adjacent and perpendicular to the walls 308, 316.

The ceiling grid system 300 of FIG. 14 also includes at least one cross-interior unflanged runner 328, which is oriented parallel to the cross-interior flanged runners 320. The cross-interior unflanged runner 328 is located along a peripheral edge or wall 332 of the room that is parallel to and opposite the wall 324 having the at least one cross-interior runner 320 attached thereto.

Figure 16:
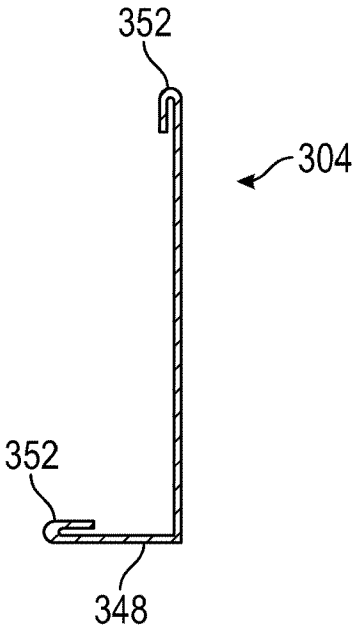
FIG. 16 is a cross-sectional view of the main runner of FIG. 15 taken along the lines 16-16 in FIG. 15.
Figure 15:
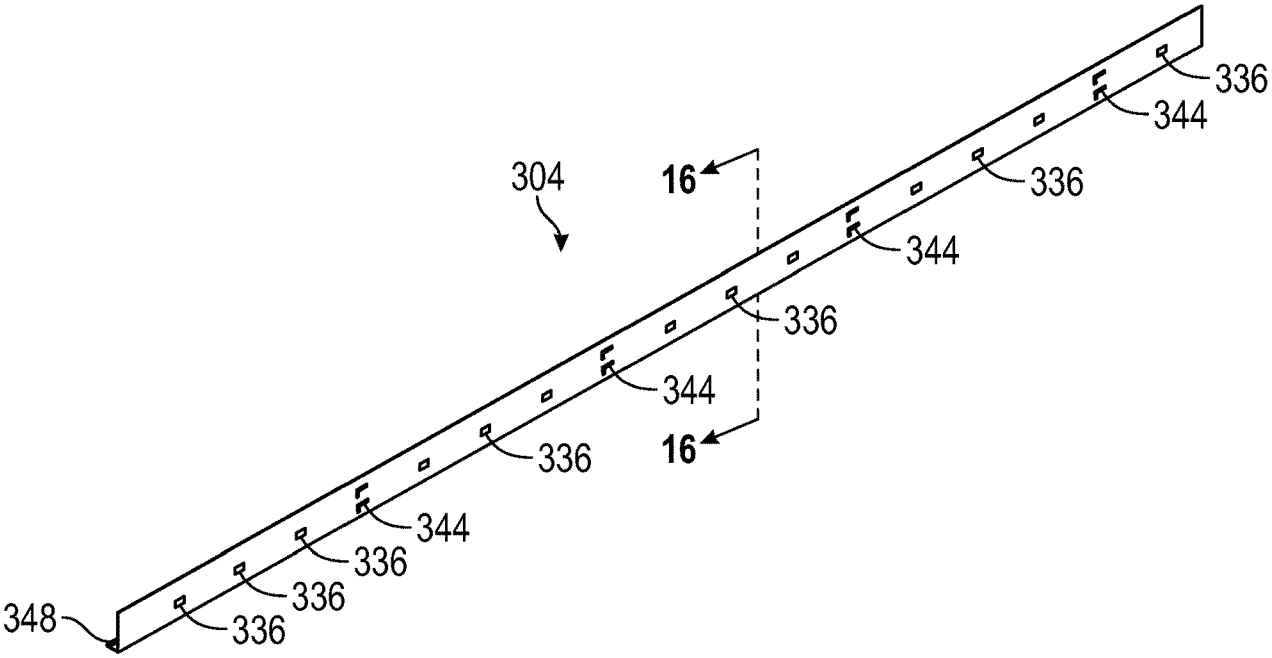
FIG. 15 is an isometric view of a main runner according to the embodiment of the present invention of FIG. 14.

Referring to FIG. 15, there illustrated is an isometric view of the main runner 304. FIG. 16 illustrates a cross-sectional view of the main runner 304. The main runner 304 has a plurality of holes or slots 336 formed therein at spaced apart intervals along a length of the main runner 304. As described and illustrated in greater detail hereinafter, the slots 336 are operable to engage with corresponding hooks that are part of a panel support member 340. Other holes 344 formed in the main runner 304 engage with tabs formed at the ends of the cross-interior flanged runners 320 and of the cross-interior unflanged runners 328, similar to the tabs 148 of embodiments described hereinabove and illustrated in FIGS. 1-13. The side of the main runner 304 that engages with the panel support member 340 is referred to as the operable side of the main runner 304.

The main runner 304 also has a fixed horizontal flange 348 formed therein along the entire length of the main runner 304. The horizontal flange 348 supports a ceiling panel 108. The side of the main runner 304 having the horizontal flange 348 is referred to as the fixed side of the main runner 304 as it interfaces directly with the ceiling panel 108 and without the use of a panel support member 340.

The main runner 304 is illustrated in FIGS. 15 and 16 as having each of its ends formed with a 180 degree return 352. In the return 352, a small portion of the material comprising the main runner 304 is bent back on itself at the ends. In embodiments of the present invention, the return 352 is optional and may be used when the material comprising the main runner 304 (or any of the runners) is a lighter gauge steel. However, the return 352 may be used with other rigid materials such as aluminum, plastic or other metals. The return 352 may be used to avoid any sharp edges at the ends of the main runners 304 resulting from manufacturing processes such as shearing, punching, or laser cutting.

Although not illustrated in the drawings but nevertheless should be readily apparent to one of ordinary skill in the art based on the teachings herein, each one of the plurality of cross-interior flanged runners 320, similar to each one of the main runners 304, includes the holes or slots 336, and has the tabs instead of the holes 344. Also, the cross-sectional profile of the cross-interior flanged runner 320 is similar to that of the main runner 304 in that a fixed horizontal flange 348 is included.

Further, although not illustrated in the drawings but nevertheless should be readily apparent to one of ordinary skill in the art based on the teachings herein, the edge main runner 312 is similar is all aspects to the main runner 304, except that the edge main runner 312 does not include the fixed horizontal flange 348. This is because the placement of the edge main runner 312 in the ceiling grid system 300 of the embodiments of FIG. 14 is such that the edge main runner 312 is not required to support a ceiling panel 108.

Figure 18:
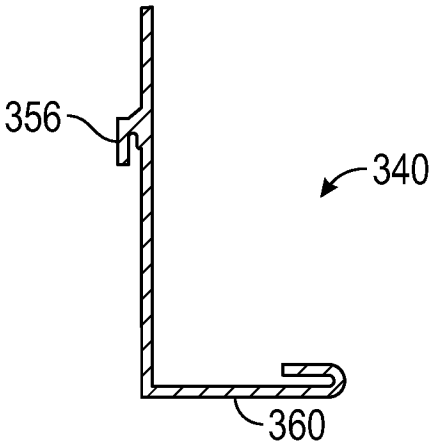
FIG. 18 is a cross-sectional view of the panel support member of FIG. 17 taken along the lines 18-18 in FIG. 17.
Figure 17:
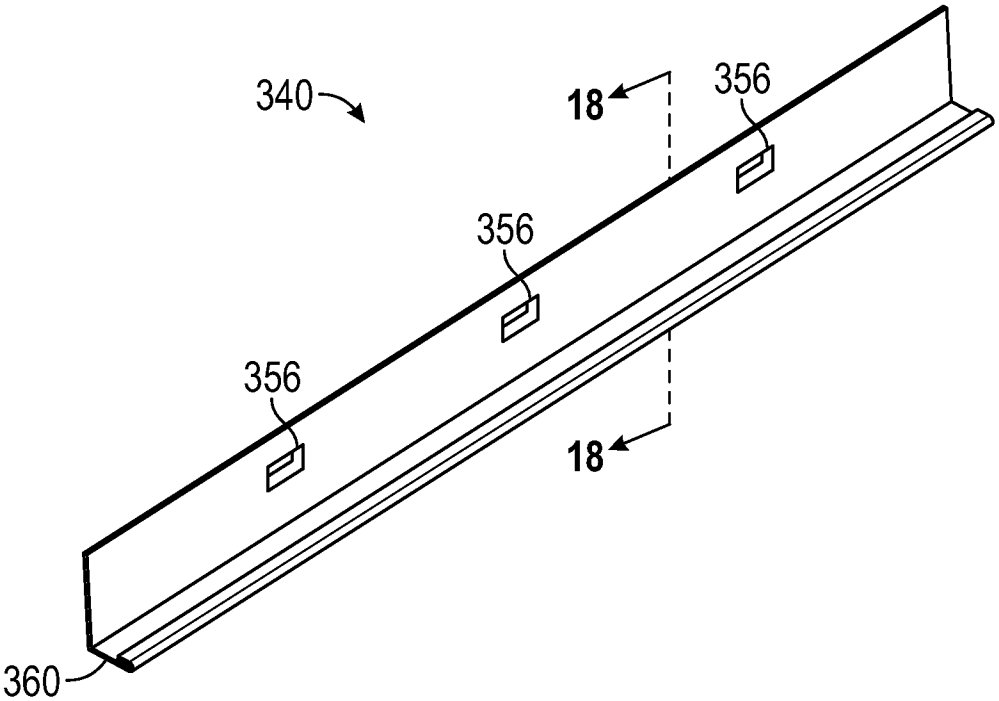
FIG. 17 is an isometric view of a panel support member according to the embodiment of the present invention of FIG. 14.

Referring to FIG. 17, there illustrated is an isometric view of the panel support member 340. FIG. 18 illustrates a cross-sectional view of the panel support member 340. The panel support member 340 has a plurality of hooks 356 formed therein at spaced apart intervals along a length of the panel support member 340. Each of the hooks 356 is operable to engage with a corresponding one of the holes or slots 336 in the main runner 304, the edge main runner 312, the cross-interior flanged runner 320, and the cross-interior unflanged runner 328. The panel support member 340 also has a fixed horizontal flange 360 formed therein along a length of panel support member 340. The horizontal flange 360 supports a ceiling panel 108.

The hooks 356 in the panel support members 340 and the corresponding holes or slots 336 in the various runners 304, 312, 320, and 328 may be formed, for example, using one of the many variations of the known lance and form method. This method lends itself well to the relatively quick, easy and inexpensive manufacturing and high-volume production of these types of physical features in lighter gauge metals or aluminum that may comprise the various components of a ceiling grid system 100, 300. However, other known methods for manufacturing the various components described and illustrated herein of the ceiling grid system 100, 300 of embodiments of the present invention may be utilized as appropriate.

It should be understood that the ceiling grid system 300 of the various embodiments of the present invention described and illustrated herein is not limited to protrusions in the shape of hooks 356. Instead, the panel support members 340 may have other shapes and styles of protrusions 356 formed therein, for example, a circular or semicircular protrusion 356 in the shape of a button may be utilized. As such, the corresponding holes or slots 336 formed in the various runners 304, 312, 320, and 328 are shaped accordingly (e.g., a keyhole) to properly accept the button or other shape and style of protrusion 356. Button-shaped protrusions 356 are oftentimes utilized when it is desired to make a connection between two elements or members aligned along the same axis or in parallel (e.g., a panel support member 340 and a main runner 304), instead of members that are perpendicular to one another (e.g., a main runner 304 and a cross-interior flanged runner 320). Thus, button and keyhole connections can be utilized within all of the various embodiments of the ceiling grid system 100, 300, 400 described and illustrated herein. The shape and style of protrusion 356 may be chosen in large part due to the manufacturing process selected (e.g., lance and form) to cost-efficiently and rapidly produce the panel support members 340 and the various runners 304, 312, 320, and 328 in relatively large production quantities. Also, it should be understood that the protrusions 356 may instead be formed in the runners 304, 312, 320, and 328 and the holes or slots 336 may instead be formed in the panel support members 340. In this alternative embodiment, the hooks 356 would be formed facing upward instead of downward so as to accommodate the holes or slots 336 and thereby hold the panel support members 340 in place.

In use, to install a panel support member 340 within an opening 124 within the ceiling grid system 300 of FIG. 14, all that is required is for someone to simply position the hooks 356 of the panel support member 340 within the holes or slots 336 in the main runner 304, the edge main runner 312, the cross-interior flanged runner 320, or the cross-interior unflanged runner 328. This can be performed with a ceiling panel 108 already positioned generally within an opening 124 in the ceiling grid system 300. The panel support member 340 is then moved vertically downward slightly so that the hooks 356 engage with the lower edge of each of the holes or slots 336. The ceiling panel 108 can then be adjusted or maneuvered slightly so that it rests on the associated runners 304, 312, 320 and/or 328.

In contrast, to remove a panel support member 340 from an opening 124 within the ceiling grid system 300 of FIG. 14, all that is required is for someone to simply push vertically upward and then inward slightly on the panel support member 340 towards the inside of the opening 124. This will disengage the hooks 356 from the holes or slots 336 in the main runner 304, the edge main runner 312, the cross-interior flanged runner 320, or the cross-interior unflanged runner 328. This can be performed on both of the panel support members 340 that are utilized within any one of the openings 124 of the ceiling grid system 300 of FIG. 14. Also, this generally vertical linear movement of the panel support members 340 can be performed by someone from below the ceiling grid system 300 in accordance with embodiments of the present invention. As such, this will allow for the relatively quick and easy removal of a ceiling panel 108 from within an opening 124 of the ceiling grid system 300 and without damaging the ceiling panel as in prior art ceiling grid systems.

Figure 19:
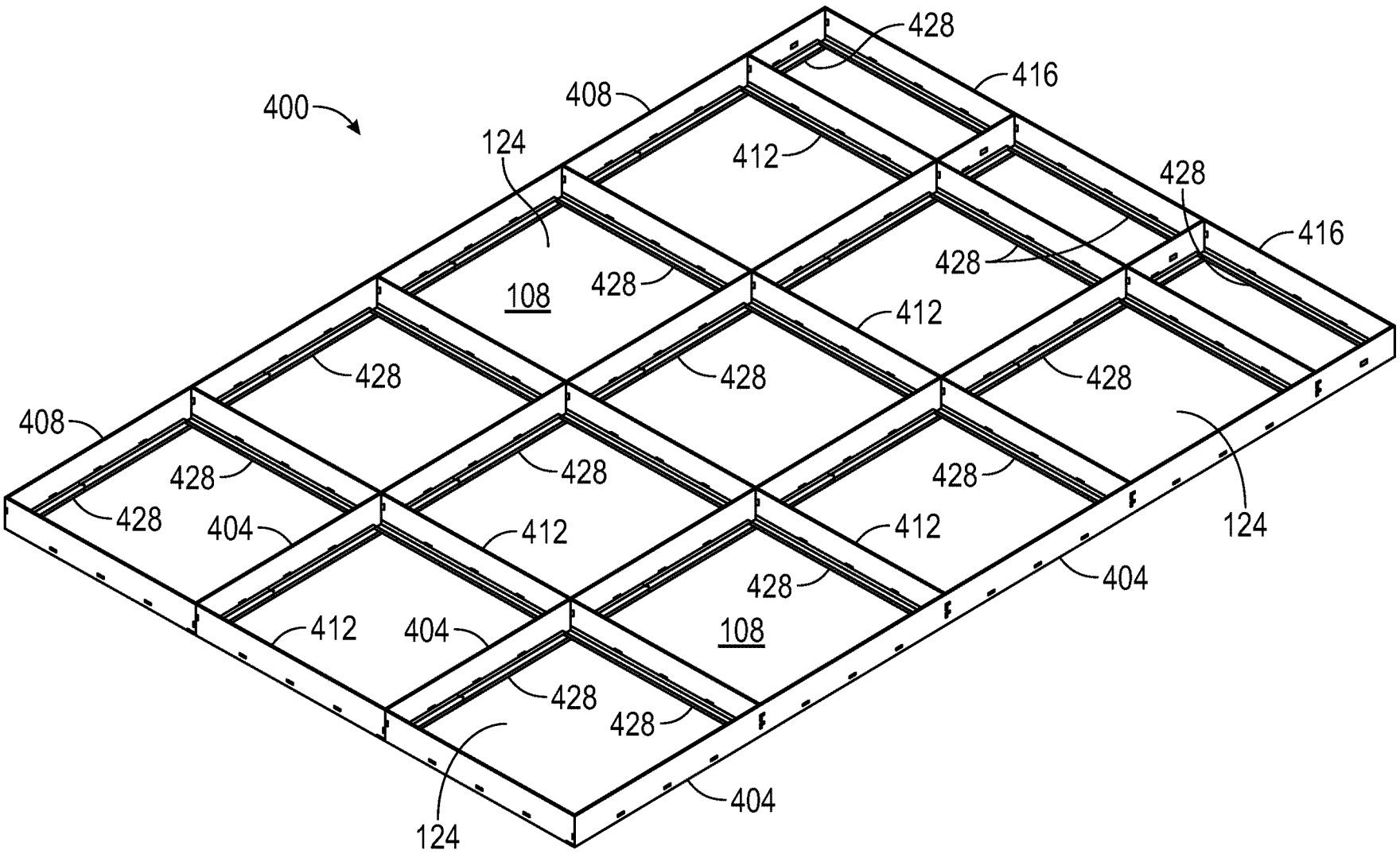
FIG. 19 is an isometric view of a ceiling grid system according to yet another embodiment of the present invention.

Referring to FIG. 19, there illustrated is an isometric view of a ceiling grid system 400 according to yet another embodiment of the present invention. The ceiling grid system 400 is similar in many structural and functional aspects to the embodiments of both ceiling grid systems 100, 300 described hereinabove and illustrated in FIGS. 1-18. The primary differences between the ceiling grid systems 100, 300, 400 relate to the structure and function of the main runners, cross-runners, and panel support members.

Similar to the ceiling grid system 300 of FIGS. 14-18, the ceiling grid system 400 of FIG. 19 includes a plurality of main runners 404, at least one edge main runner 408, a plurality of cross-interior flanged runners 412, and at least one cross-interior unflanged runner 416. These runners 404, 408, 412, 416 may be positioned and oriented within the ceiling grid system 400 in a similar manner as in the ceiling grid system 300 of FIGS. 14-18.

Figure 20:
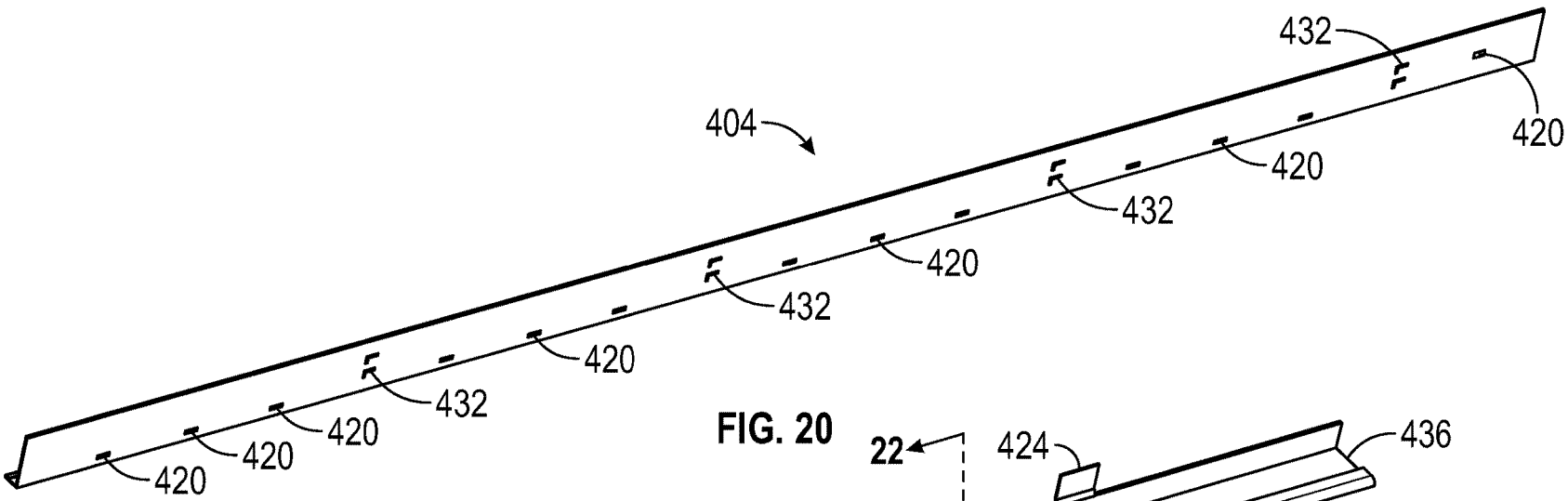
FIG. 20 is an isometric view of a main runner according to the embodiment of the present invention of FIG. 19.

Referring to FIG. 20, there illustrated is an isometric view of a main runner 404 according to the embodiment of the ceiling grid system 400 of FIG. 19. The main runner 404 has a plurality of holes or slots 420 formed therein at spaced apart intervals along a length of the main runner 404. As described and illustrated in greater detail hereinafter, the slots 420 are operable to engage with corresponding curved S-shaped tabs or "S-tabs" 424 that are part of a panel support member 428. Other holes 432 formed in the main runner 404 engage with tabs formed at the ends of the cross-interior flanged runners 412 and the cross-interior unflanged runners 416, similar to the embodiments described hereinabove and illustrated in FIGS. 1-18. Thus, the structure of the main runner 404 is the same as the structure of the main runner 304 of the embodiment of the ceiling grid system 300 of FIGS. 14-18, with the exception of the size and location of the holes or slots 420 formed in the main runner 404. The differences in the holes or slots 420 are due to the use of the S-tabs 424 in the panel support members 428 in the embodiment of the ceiling grid system 400 of FIG. 19 compared to the use of hooks 365 in the panel support members 340 in the embodiment of the ceiling grid system 300 of FIGS. 14-18. Therefore, besides these holes or slots 420 in the main runner 404, the same holes or slots 420 are also formed in the at least one edge main runner 408, the plurality of cross-interior flanged runners 412, and the at least one cross-interior unflanged runner 416.

Figure 21:
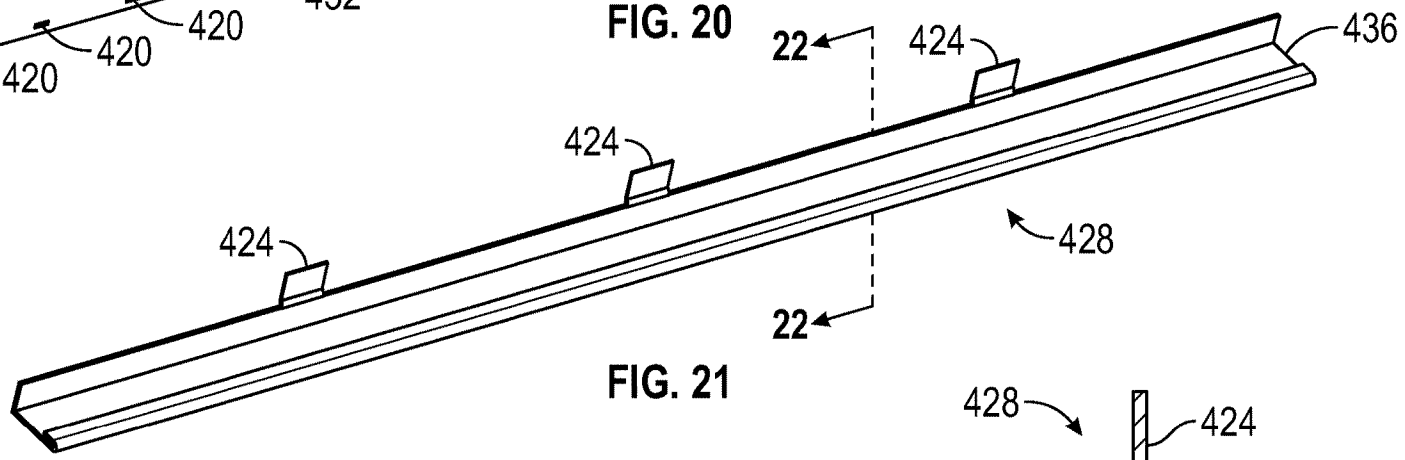
FIG. 21 is an isometric view of a panel support member according to the embodiment of the present invention of FIG. 19.
Figure 22:
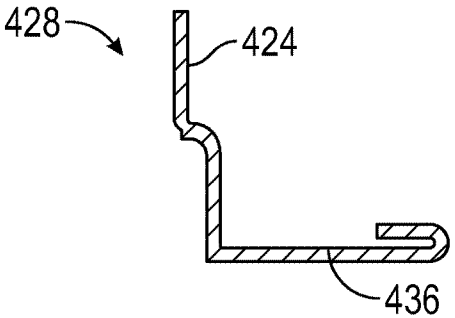
FIG. 22 is a cross-sectional view of the panel support member of FIG. 21 taken along the lines 22-22 in FIG. 21.

Referring to FIG. 21, there illustrated is an isometric view of a panel support member 428 according to the embodiment of the ceiling grid system 400 of FIG. 19. FIG. 22 is a cross-sectional view of the panel support member 428 in which the curved "S" shape of the tab 424 can be better seen. The panel support member 428 has the plurality of S-tabs 424 formed therein at spaced apart intervals along a length of the panel support member 440. Each of the S-tabs 424 is operable to engage with a corresponding one of the holes or slots 420 in the main runner 404, the edge main runner 408, the cross-interior flanged runner 412, and the cross-interior unflanged runner 416. The panel support member 428 also has a fixed horizontal flange 436 formed therein along a length of panel support member 428. The horizontal flange 436 supports a ceiling panel 108. The S-tabs 424 in the panel support members 428 and the corresponding holes or slots 420 in the various runners 404, 408, 412, and 416 may be formed, for example, using one of the many variations of the known lance and form method, or by other known manufacturing methods. However, it should be understood that the ceiling grid system 400 of embodiments of the present invention are not limited to S-shaped tabs 424. Other shapes of a curve for the tab 424 may be utilized that are apparent to one of ordinary skill in the art in light of the teachings herein. Also, it should be understood that the S-tabs 424 may instead be formed in the runners 404, 408, 412, and 416, and the holes or slots 420 may instead be formed in the panel support member 440.

In use, a panel support member 428 is installed within an opening 124 in the ceiling grid system 400 of FIG. 19 by hanging the panel support member 428 from one of the runners 404, 408, 412, 416. This is performed by rotating the panel support member 428 so that its curved S-tabs 424 are generally moving towards a horizontal position. The S-tabs 424 are then inserted into the corresponding holes or slots 420 in the runner 404, 408, 412, 416, and the panel support member 428 is rotated downward into a vertical position. This can be performed with a ceiling panel 108 already positioned generally within an opening 124 in the ceiling grid system 400. The ceiling panel 108 can then be adjusted or maneuvered slightly so that it rests on the associated runners 404, 408, 412, and/or 416.

In contrast, to remove a panel support member 428 from an opening 124 within the ceiling grid system 400 of FIG. 19, all that is required is for someone to rotate the panel support member 428 upwards towards a horizontal position. This will disengage the S-tabs 424 from the holes or slots 420 in the main runner 404, the edge main runner 408, the cross-interior flanged runner 412, or the cross-interior unflanged runner 416. This can be performed on both of the panel support members 428 that are utilized within any one of the openings 124 of the ceiling grid system 400 of FIG. 19. Also, this movement of the panel support members 428 can be performed by someone from below the ceiling grid system 400 in accordance with embodiments of the present invention. As such, this will allow for the relatively quick and easy removal of a ceiling panel 108 from within an opening 124 of the ceiling grid system 400 and without damaging the ceiling panel as in prior art ceiling grid systems. Further, the embodiment of the ceiling grid system 400 of FIGS. 19-22 can be considered to be a rotatable embodiment due to the rotation of the panel support member 428 with respect to the runners 404, 408, 412, 416 during installation and removal, as described hereinabove.

Figure 23:
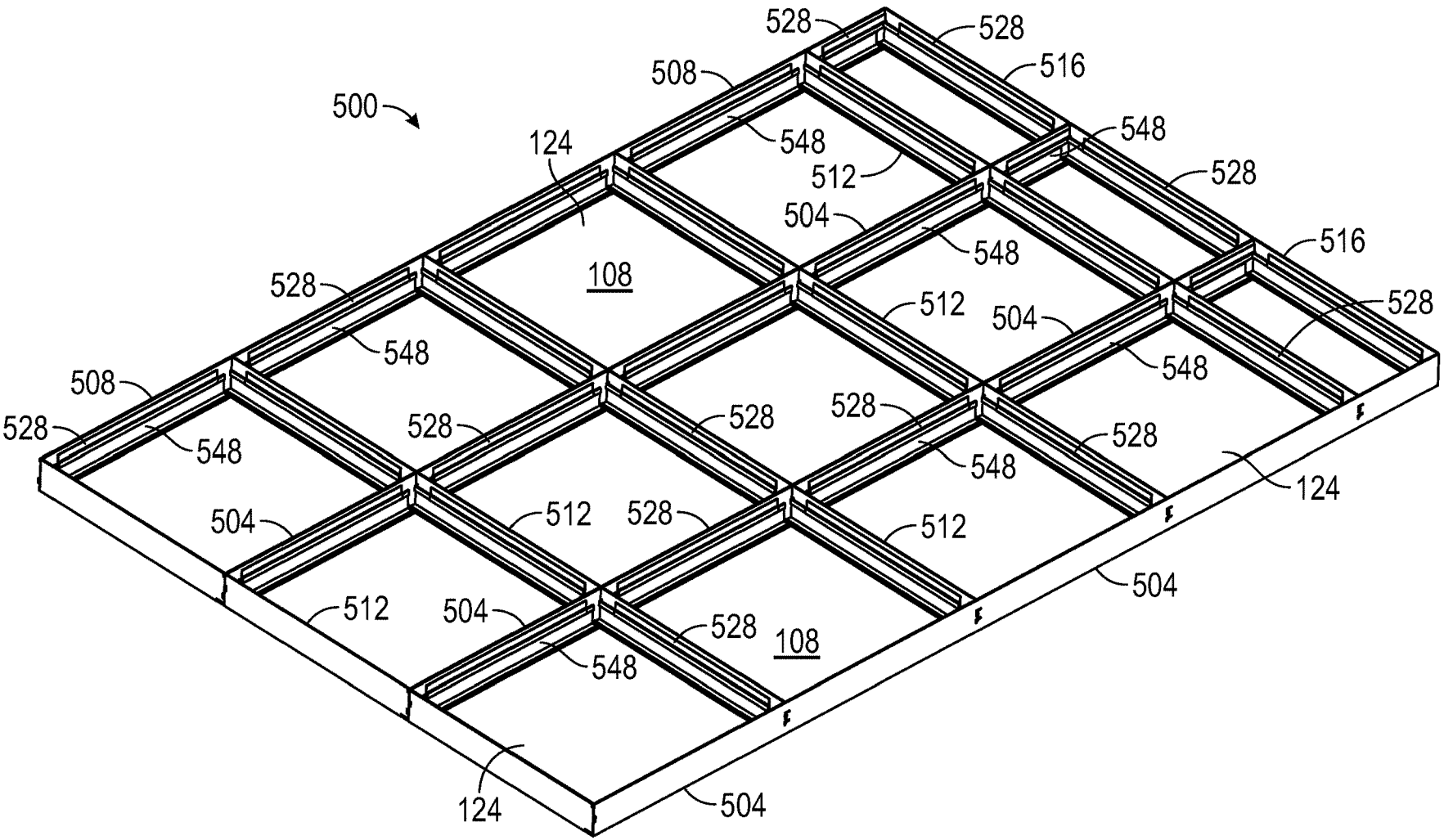
FIG. 23 is an isometric view of a ceiling grid system according to still another embodiment of the present invention.

Referring to FIG. 23, there illustrated is an isometric view of a ceiling grid system 500 according to still another embodiment of the present invention. The ceiling grid system 500 is similar in many structural and functional aspects to the embodiments of the ceiling grid systems 100, 300, 400 described hereinabove and illustrated in FIGS. 1-22. The primary differences between the ceiling grid systems 100, 300, 400, 500 relate to the structure and function of the main runners, cross-runners, and panel support members.

Similar to the ceiling grid systems 300, 400 of FIGS. 14-22, the ceiling grid system 500 of FIG. 23 includes a plurality of main runners 504, at least one edge main runner 508, a plurality of cross-interior flanged runners 512, and at least one cross-interior unflanged runner 516. These runners 504, 508, 512, 516 may be positioned and oriented within the ceiling grid system 500 in a similar manner as in the ceiling grid systems 300, 400 of FIGS. 14-22.

Figure 24:
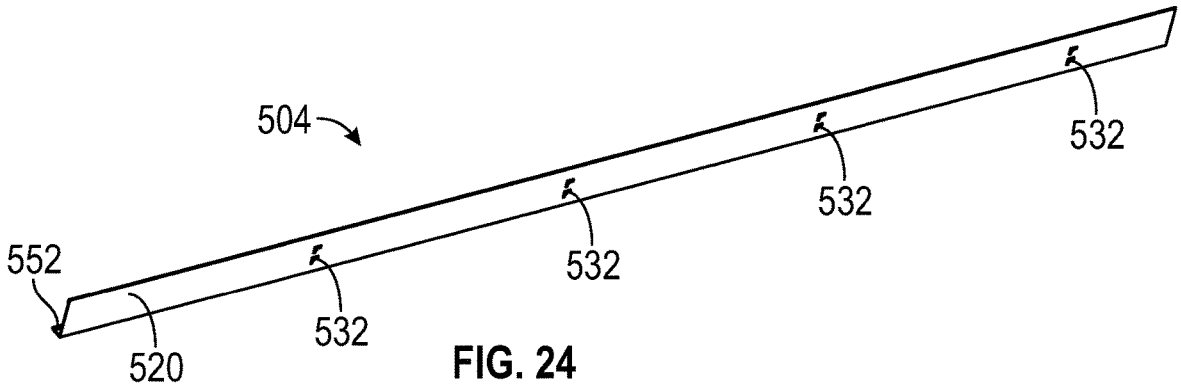
FIG. 24 is an isometric view of a main runner according to the embodiment of the present invention of FIG. 23.

Referring to FIG. 24, there illustrated is an isometric view of a main runner 504 according to the embodiment of the ceiling grid system 500 of FIG. 23. The main runner 504 has a generally planar surface 520 on one side along a length of the main runner 504. As described and illustrated in greater detail hereinafter, the surface 520 is configured to connect with or attach to a surface 524 of a receptor 528. A plurality of holes 532 formed in the main runner 504 engage with tabs formed at the ends of the cross-interior flanged runners 512 and the cross-interior unflanged runners 516, similar to the embodiments of the ceiling grid systems 100 300, 400 described hereinabove and illustrated in FIGS. 1-22.

Figure 25:
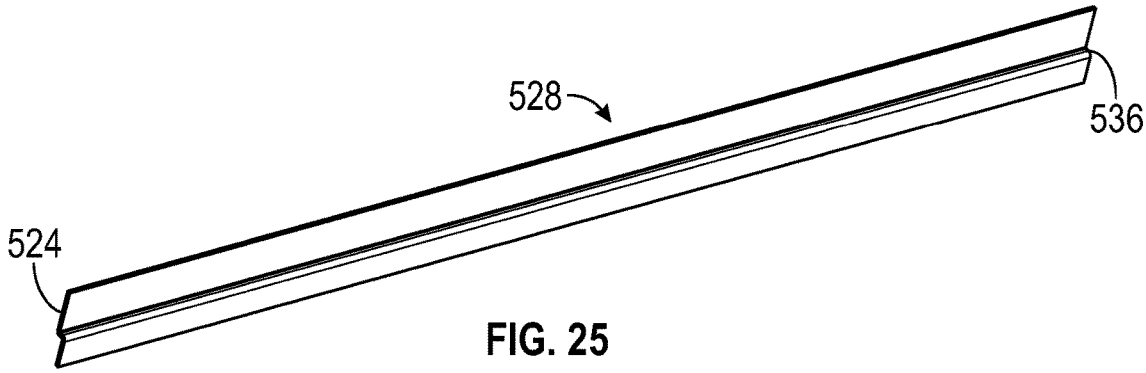
FIG. 25 is an isometric view of a receptor according to the embodiment of the present invention of FIG. 23.
Figure 26:
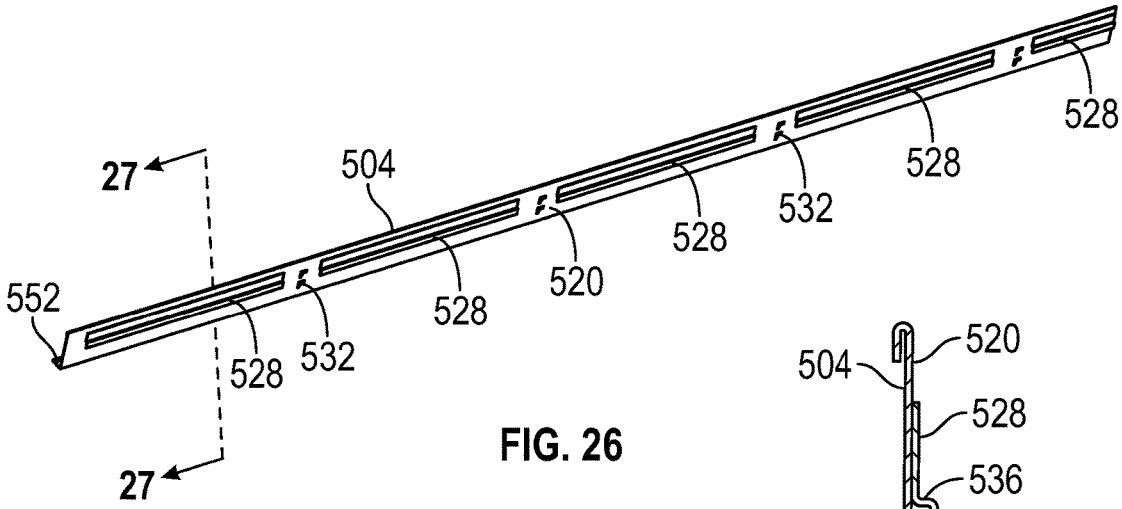
FIG. 26 is an isometric view of the main runner of FIG. 24 connected with the receptor of FIG. 25 according to the embodiment of the present invention of FIG. 23.
Figure 27:
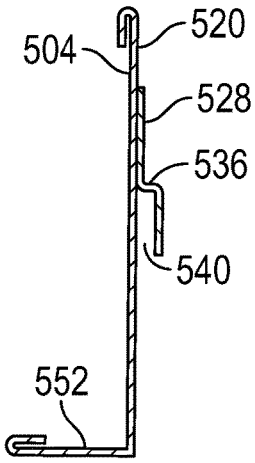
FIG. 27 is a cross-sectional view of the main runner of FIG. 24 connected with the receptor of FIG. 25 as shown in FIG. 26 and taken along the lines 27-27 in FIG. 26.

Referring to FIGS. 25-27, FIG. 25 is an isometric view of the receptor 528, while FIGS. 26 and 27 are isometric and cross-sectional views, respectively, of the main runner 504 connected with or attached to the receptor 528. The receptor 528 includes the generally planar rear surface 524 which attaches to or connects with the surface 520 of the main runner 504. The connection or attachment between the main runner 504 and the receptor 528 may be achieved through appropriate use of adhesives or connecting devices such as screws or rivets, or other known, common means of connection or attachment. FIG. 26 illustrates a plurality of receptors 528 connected with or attached to a single main runner 504 along a length thereof in a typical configuration of the ceiling grid system 500 of the embodiment of FIG. 23. FIG. 26 is also representative of a similar configuration of a plurality of receptors 528 connected with or attached to either a single edge main runner 508, a single cross-interior flanged runner 512, or a single cross-interior unflanged runner 516, according to various alternative embodiments of the ceiling grid system 500 of the present invention.

Figure 30:
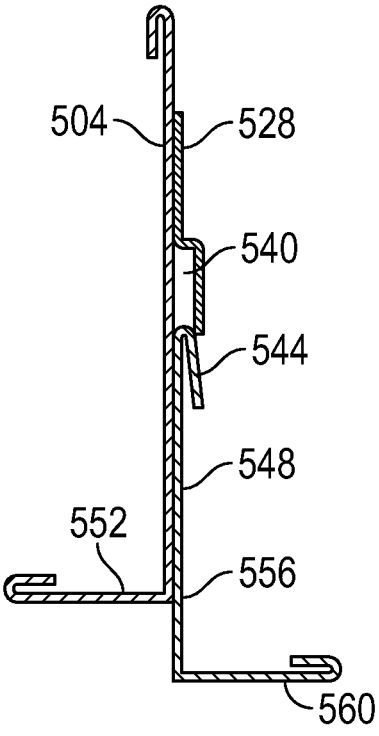
FIG. 30 is a cross-sectional view of the main runner of FIG. 24 connected with the receptor of FIG. 25 and with the panel support member of FIG. 28 in an open position with respect thereto.
Figure 31:
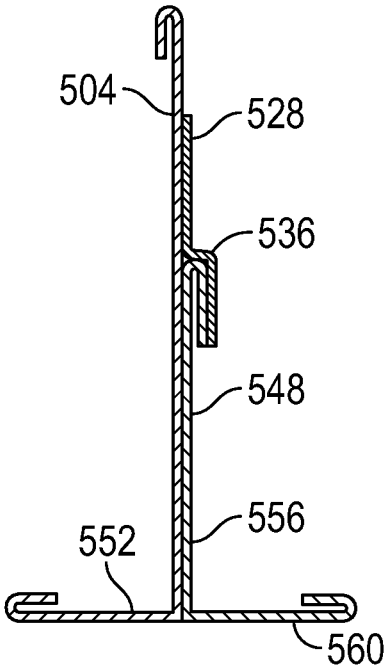
FIG. 31 is a cross-sectional view of the main runner of FIG. 24 connected with the receptor of FIG. 25 and with the panel support member of FIG. 28 in a closed position with respect thereto.

The receptor 528 also has an S-curve portion 536 formed therein which creates a receiving area 540, as best seen in FIG. 27, in which the receptor 528 connects with or attaches to the main runner 504. As described and illustrated in greater detail hereinafter with respect to FIGS. 30 and 31, the receiving area 540 is configured to receive an upper portion 544 of a panel support member 548 to thereby hold the panel support member 548 in place in a "snap-in" type manner. Thus, the side of the main runner 504 with the receptor 528 may be referred to as the "operable" side of the main runner 504.

The main runner 504 also includes a fixed horizontal leg or flange 552 that is configured to support a ceiling panel 108, in a similar manner to the ceiling grid systems 100, 300, 400 of the embodiments of FIGS. 1-22. Thus, the side of the main runner 5604 having the horizontal flange 552 may be referred to as the "fixed" side of the main runner 504.

Figure 28:
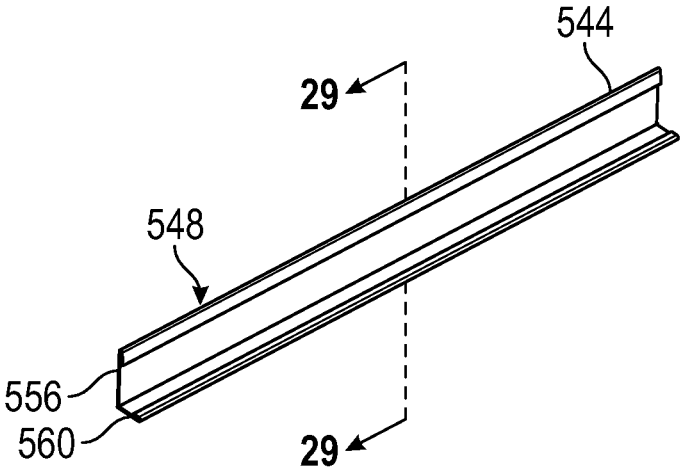
FIG. 28 is an isometric view of a panel support member according to the embodiment of the present invention of FIG. 23.
Figure 29:
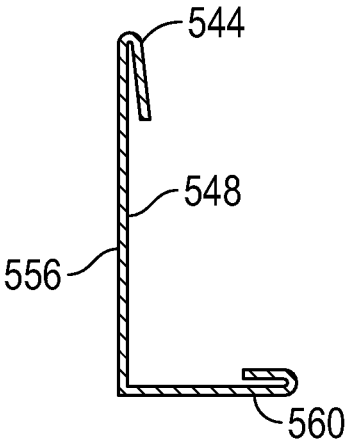
FIG. 29 is a cross-sectional view of the panel support member of FIG. 28 taken along the lines 29-29 in FIG. 28.

Referring to FIGS. 28 and 29, there illustrated is an isometric view and a cross-sectional view, respectively, of a panel support member 548 according to the embodiment of the ceiling grid system 500 of FIG. 23. The cross-sectional profile of the panel support member 548 includes: (a) a vertical leg 556 having the upper portion 544 that fits into (e.g., "snaps-in") the receiving area 540 of the receptor 528; and (b) a fixed horizontal leg or flange 560 along the length of the panel support member 548 and which supports one of the ceiling panels 108 other than the ceiling panel 108 supported by the corresponding flange 552 of the same main runner 504 that the particular receptor 528 is attached to. The panel support member 548 may have a length that approximately equals the length of the receptor 528.

In use, each receptor 528 is typically, although not strictly necessary, connected with or attached to the corresponding main runner 504, the single edge main runner 508, the single cross-interior flanged runner 512, or the single cross-interior unflanged runner 516 prior to or during the installation of the ceiling grid system 500 within the room. Each panel support member 548 is then installed within an opening 124 in the ceiling grid system 500 of FIG. 23. This is done by inserting the panel support member 548 into the receptor 528 associated with the corresponding runner 504, 508, 512, 516 such that the upper portion 544 of the panel support member 548 is placed or snaps into a locking position with respect to the receiving area 540 of the receptor 548. The placement of the panel support member 548 within the receptor can be carried out with an upward vertical movement of the panel support member 548 into the receptor 528. This can be performed with a ceiling panel 108 already positioned generally within an opening 124 in the ceiling grid system 500. The ceiling panel 108 can then be adjusted or maneuvered slightly so that it rests on the associated runners 504, 508, 512, 516.

In contrast, to remove a panel support member 548 from an opening 124 within the ceiling grid system 500 of FIG. 23, all that is required is for someone to move the panel support member 548 in a downward vertical direction such that the panel support member 548 is no longer held by the receptor 528. This can be performed on both of the panel support members 548 that are utilized within any one of the openings 124 of the ceiling grid system 500 of FIG. 23. Also, this movement of the panel support members 548 can be performed by someone from below the ceiling grid system 500 in accordance with embodiments of the present invention. As such, this will allow for the relatively quick and easy removal of a ceiling panel 108 from within an opening 124 of the ceiling grid system 500 and without damaging the ceiling panel as in prior art ceiling grid systems. Further, the embodiment of the ceiling grid system 500 of FIGS. 23-31 can be considered to be a linear movement embodiment due to the upward or downward linear vertical movement of the panel support member 548 with respect to the runners 504, 508, 512, 516 during installation and removal, as described hereinabove.

Figure 32:
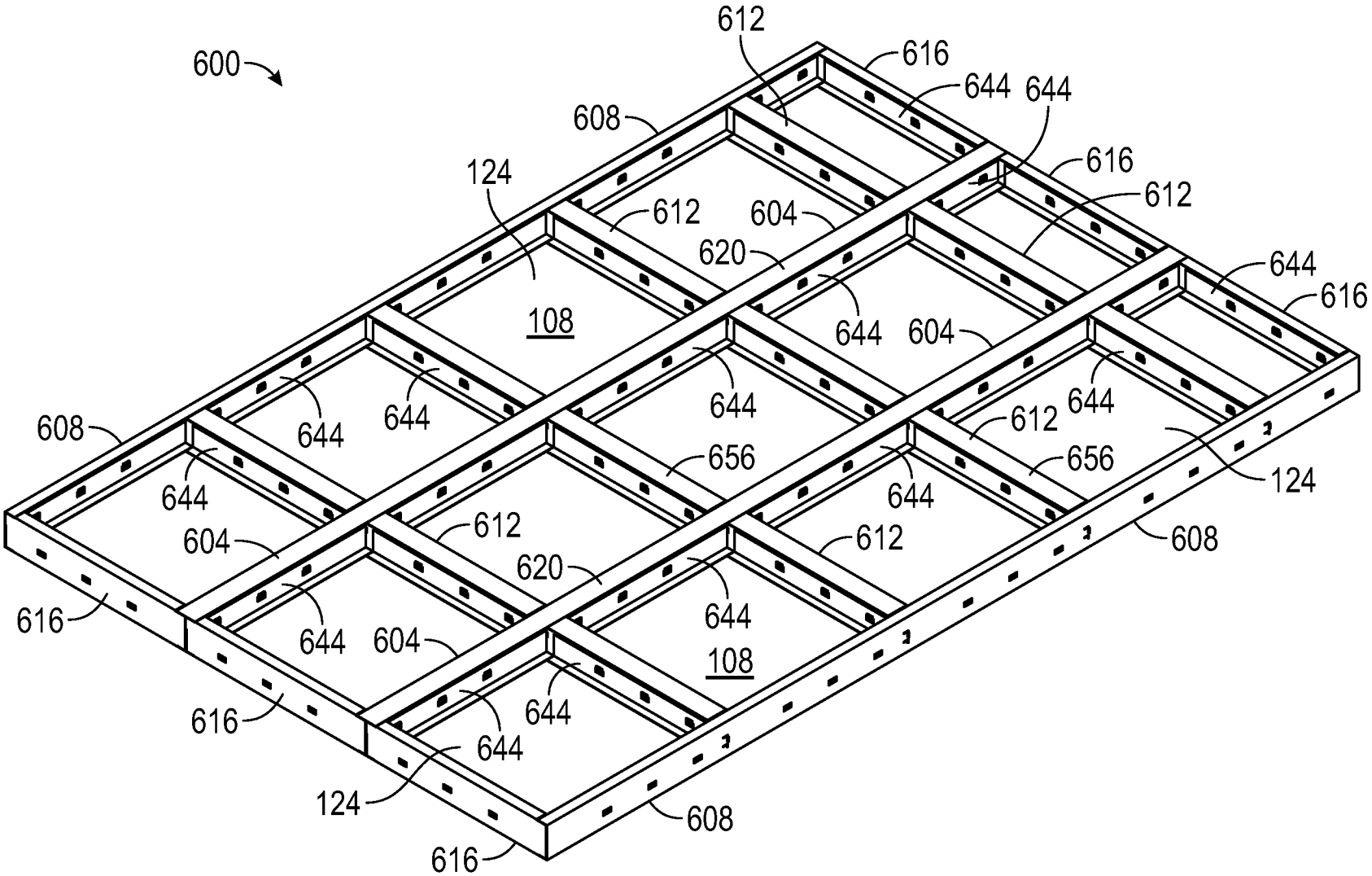
FIG. 32 is an isometric view of a ceiling grid system according to another embodiment of the present invention.

Referring to FIG. 32, there illustrated is an isometric view of a ceiling grid system 600 according to another embodiment of the present invention. The ceiling grid system 600 is similar in many structural and functional aspects to the embodiments of the ceiling grid system 100, 300, 400, 500 described hereinabove and illustrated in FIGS. 1-31. The primary differences between the ceiling grid systems 100, 300, 400, 500, 600 relate to the structure and function of the main runners, cross-runners, and panel support members.

More specifically, in the various embodiments of the ceiling grid system 100, 300, 400, 500 described hereinbefore and illustrated in FIGS. 1-31, the main runners 104, 304, 404, 504 and the edge angle runner 232 each includes horizontal flanges 132, 240, 348, 552 that are configured in part to support ceiling panels 108. However, these flanges 132, 240, 348, 552 are also configured to stiffen the runners 104, 232, 304, 404, 504 to thereby keep the runners in a straight line and to prevent any undesirable waving of the runners. This is also the same flanged structural configuration for the various interior runners 120, 248, 320, 412, 512. As described and illustrated, the flanges 132, 240, 348, 552 are located in the same horizontal plane as that of the bottom surface of the ceiling panels 108 when the overall suspended ceiling is installed in a room.

However, it should be understood that the broadest scope of the ceiling grid system 100, 300, 400, 500 of embodiments of the present invention does not necessarily require any structural stiffening of various components such as the runners 104, 232, 304, 404, 504, and does not require any such stiffening to be located in the same horizontal plane as that of the bottom surface of the ceiling panels 108. Instead, if such stiffening is desired and utilized, then any such stiffening may be located outside of the horizontal plane of the bottom surface of the ceiling panels 108. In the exemplary embodiment of the ceiling grid system 600 illustrated in FIG. 32 and described in detail hereinafter, the stiffening of the various components may be located above the horizontal plane of the bottom surface of the ceiling panels 108.

In a somewhat similar structural configuration to the structural configurations of the ceiling grid systems 100, 300, 400, 500 of FIGS. 1-31, the ceiling grid system 600 of FIG. 32 includes a plurality of main runners 604, a plurality of edge main runners 608, a plurality of cross-interior runners 612, and a plurality of cross-edge runners 616. These runners 604, 608, 612, 616 may be positioned and oriented within the ceiling grid system 500 in an array configuration that is similar to that of the ceiling grid systems 100, 300, 400, 500 of FIGS. 1-31. As noted hereinabove, the runners of these ceiling grid systems 100, 300, 400, 500 are configured to have flanges located in the same horizontal plane as that of the bottom surface of the ceiling panels 108. In contrast and in accordance with the embodiment of the ceiling grid system 600 of FIG. 32, the runners 604, 608, 612, 616 are configured to have flange stiffeners that are either, e.g., T-shaped or inverted L-shaped, as described and illustrated in more detail hereinafter. As such, the stiffener configuration of the runners 604, 608, 612, 616 is located above the horizontal plane of the bottom surface of the ceiling panels 108.

Figure 34:
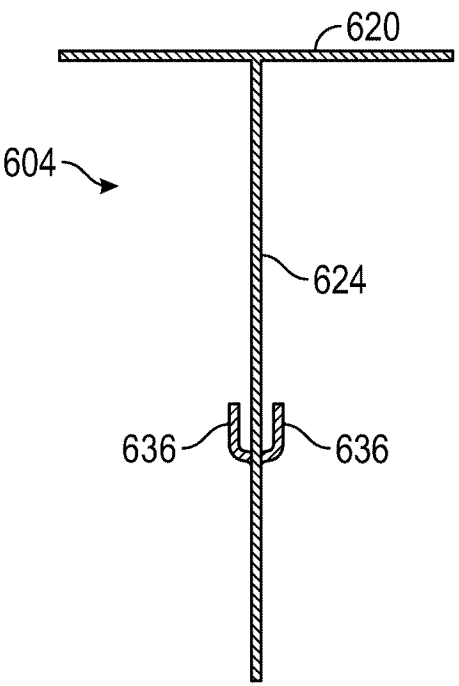
FIG. 34 is a cross-sectional view of the main runner of FIG. 33 taken along the lines 34-34 in FIG. 33.
Figure 33:
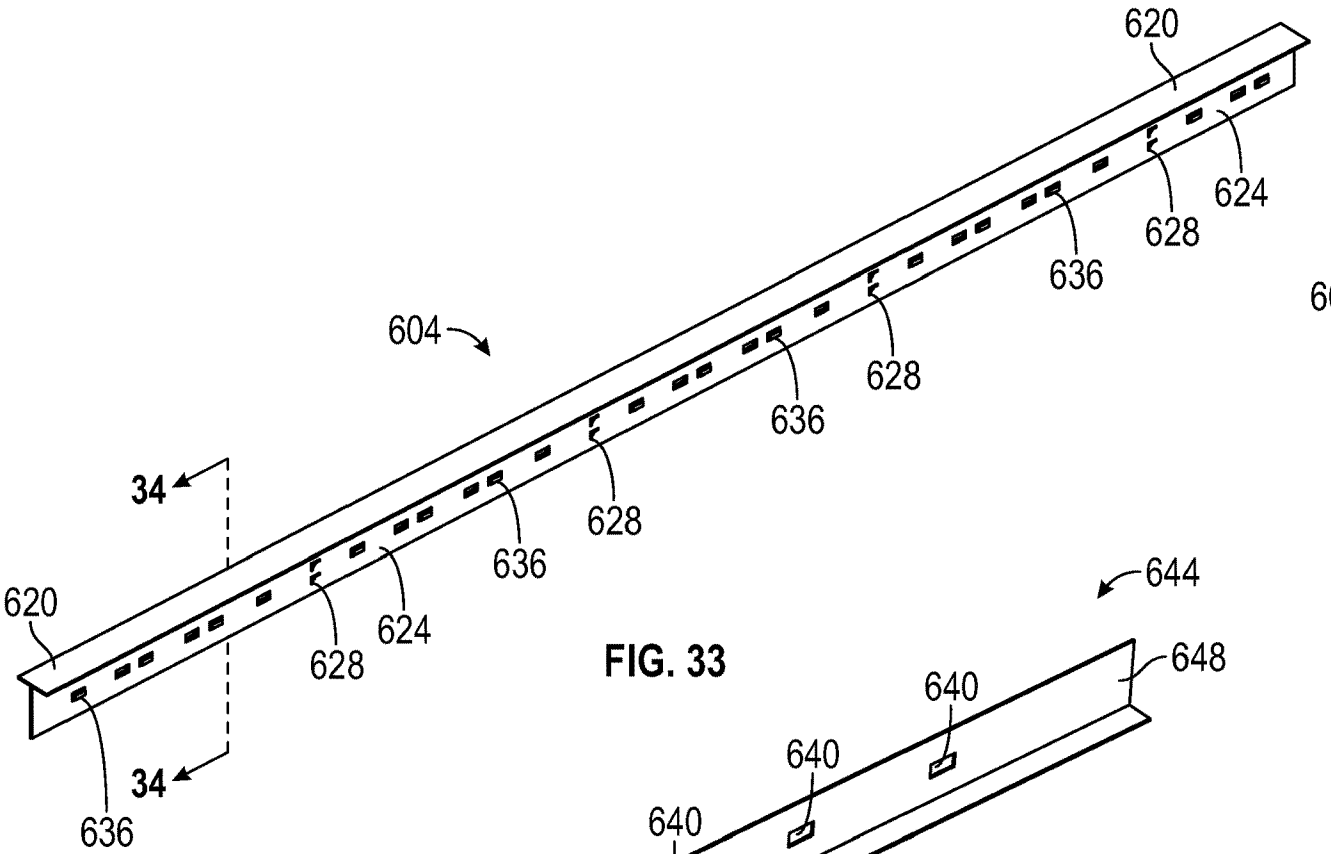
FIG. 33 is an isometric view of a main runner according to the embodiment of the present invention of FIG. 32.

Referring to FIGS. 33 and 34, FIG. 33 is an isometric view of a main runner 604 according to the embodiment of the ceiling grid system 600 of FIG. 32, while FIG. 34 is a cross-sectional view of the main runner 604 of FIG. 33 taken along the lines 34-34 in FIG. 33. The main runner 604 has a generally planar flanged surface 620 located on a top portion of the main runner 604 and extending horizontally the entire length of the main runner 604. The top flanged surface or portion 620 may function as the stiffener for the main runner 604. Although not shown, the top flanged surface 620 may attach to the ceiling or floor joists 112 using hanger clips, brackets, or wires 116 (FIG. 1).

Figure 36:
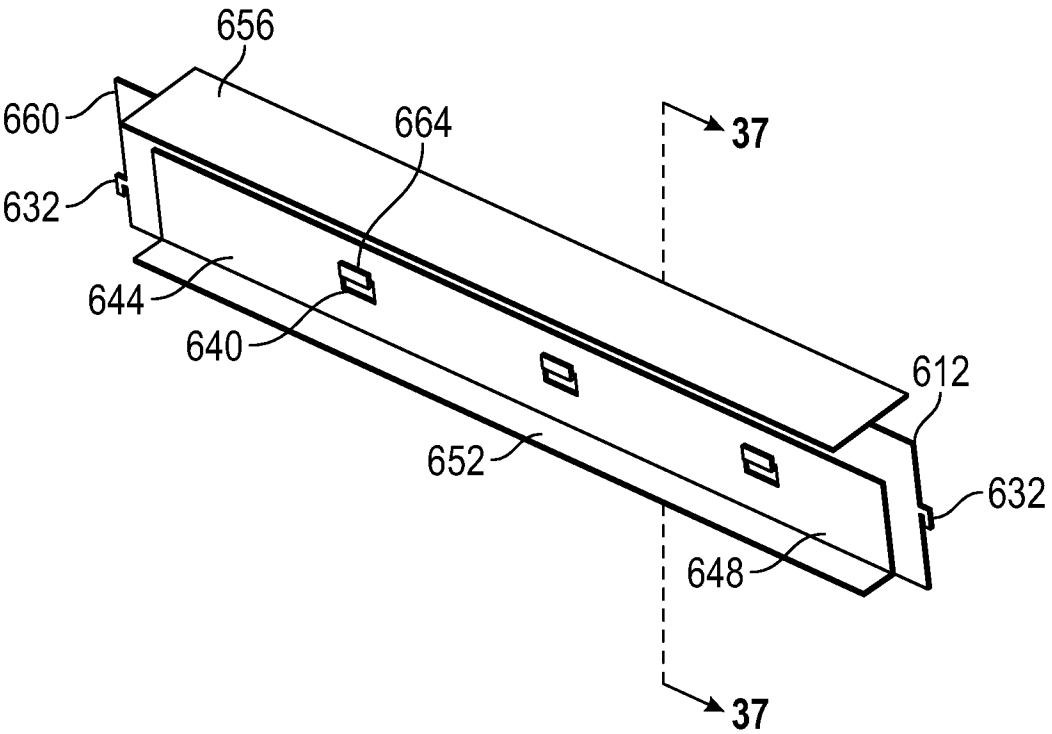
FIG. 36 is an isometric view of a cross-interior runner of FIG. 32 connected with two of the panel support members of FIG. 35.

The main runner 604 also includes a vertical leg 624 extending downward from the top flanged horizontal surface 624. As a result, the cross-sectional profile of the main runner 604 is T-shaped, as best seen in FIG. 34. In addition, the main runner 604 includes a plurality of holes 628 spaced apart along the entire length of the main runner 604. The holes are configured to connect with protrusions such as hooks 632 located on each end of the cross-interior runner (FIG. 36). The main runner 604 further includes a plurality of hooks 636 located on each opposing side of the vertical leg 624. The hooks 636 extend upward and are disposed at certain locations along the entire length of the main runner 604. As described and illustrated in more detail hereinafter, the hooks 636 connect with holes 640 formed in a panel support member 644.

Figure 35:
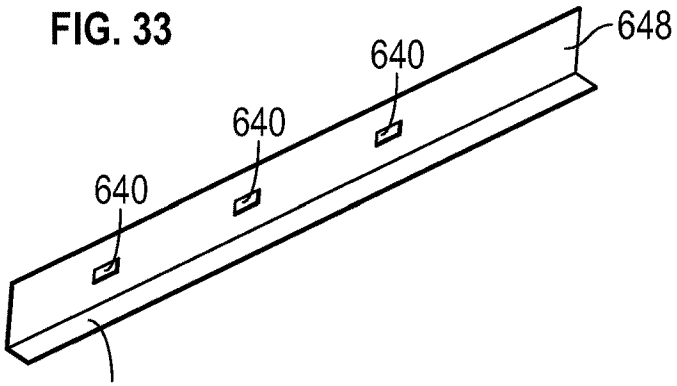
FIG. 35 is an isometric view of a panel support member according to the embodiment of the present invention of FIG. 32.

Referring to FIG. 35, there illustrated is an isometric view of a panel support member 644 according to the ceiling grid system 600 of the embodiment of the present invention of FIG. 32. The panel support member 644 includes a vertical leg 648 extending downward and which includes the holes 640 formed therein. The panel support member 644 also includes a fixed horizontal leg or flange 652 that supports one of the ceiling panels 108 when the panel support member 644 is connected with the corresponding runner 604, 608, 612, 616.

Figure 37:
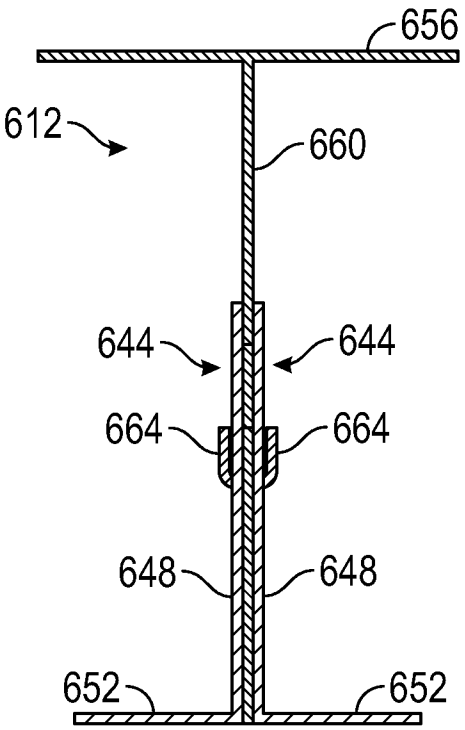
FIG. 37 is a cross-sectional view of the cross-interior runner of FIG. 32 connected with two of the panel support members of FIG. 35 taken along the lines 37-37 of FIG. 36.

Referring to FIGS. 36 and 37, FIG. 36 is an isometric view of a cross-interior runner 612 connected with two of the panel support members 644, while FIG. 37 is a cross-sectional view of the cross-interior runner 612 connected with the two panel support members 644 as shown in FIG. 36 and taken along the lines 37-37 of FIG. 36. Similar to the main runner 604, the cross-interior runner 612 has a generally planar flanged surface 656 located on a top portion of the cross-interior runner 612 and extending horizontally the entire length of the cross-interior runner 612. The top flanged surface 656 may function as the stiffener for the cross-interior runner 612.

The cross-interior runner 612 also includes a vertical leg 660 extending downward from the top flanged horizontal surface 656. Similar to the main runner 604, the vertical leg 660 of the cross-interior runner 612 has a plurality of hooks 664 located on each opposing side of the vertical leg 660. The hooks 664 extend upward and are disposed at certain locations along the entire length of the cross-interior runner 612. The hooks 664 connect with the holes 640 in the panel support member 644. As a result, the cross-sectional profile of the cross-interior runner 612 is T-shaped, as seen in FIG. 37 and similar to that of the main runner 604.

As mentioned and as best seen in FIG. 37, the cross-interior runner 612 connects with a pair of panel support members 644, one panel support member 644 being disposed on each opposing side of the cross-interior runner 612. These connections are carried out using the hooks 664 and the holes 640. It should be noted that the main runner 604 connects with the panel support members 644 in a similar manner using the hooks 636 and the holes 640.

In addition to the main runner 604 having the top flange 620 and the cross-interior runner 612 having the top flange 656 such that the cross-sectional profile of each is T-shaped, the ceiling grid system 600 of FIGS. 32-37 includes the edge main runners 608 and the cross-edge runners 616 that are disposed around the outer edges of the ceiling grid system 600 within the room. As such and although not shown, the edge main runners 608 and the cross-edge runners 616 are required to connect on only one side of the runner 608, 616 with a panel support member 644, instead of on both sides of each of the runners 604, 612 as previously described and illustrated. This results in the cross-sectional profile of each of the edge main runner 608 and the cross-edge runner 616 being of an inverted L-shaped profile. Further, the edge main runners 608 and the cross-edge runner 616 may each have similar hooks 636, 664 that connect with the holes 640 in the panel support members 644.

The embodiments of the ceiling grid systems 100, 300, 400, 500 of FIGS. 1-31 utilize flanges 132, 240, 348, 552 that are configured in part to support the ceiling panels 108 and which are also configured to stiffen the runners 104, 232, 304, 404, 504. In contrast, the embodiment of the ceiling grid system 600 of FIGS. 32-37 does not utilize the horizontal flanges 620, 656 on the runners 604, 608, 612, 616 to support the ceiling panels 108. Instead, those flanges 620, 656 are utilized to stiffen the runners 604, 608, 612, 616. As such, the ceiling grid system 600 of FIGS. 32-37 may utilize a panel support member 644 on each of the four sides of an opening 124 so as to adequately support a ceiling panel 108 within the opening 124.

Further, it should be understood that the use of the hooks 636, 664 on the runners 604, 608, 612, 616 and the use of the holes 640 on the panel support members 644 is purely exemplary. Instead, the hooks 636, 664 may be located on the panel support members 644 and the holes 640 may be located on the runners 604, 608, 612, 616, with such an alternative configuration being apparent to one of ordinary skill in the art in light of the teachings herein.

Also, the ceiling grid system 600 of the embodiment of the present invention of FIGS. 32-37 is not limited to be configured to the use of the hooks 636, 664 and the holes 640. Instead, other configurations may be used to connect the runners 604, 608, 612, 616 with the panel support members 644, including any of the various connection configurations described and illustrated hereinbefore with respect to the embodiments of the ceiling grid systems 100, 300, 400, 500.

In use, each panel support member 644 is connected with or is attached to the corresponding runners 604, 608, 612, 616 within each opening 124 during the installation of the ceiling grid system 600 of FIGS. 32-37 within the room. This is done by inserting the holes 640 of the panel support member 644 onto the hooks 636, 664 such that the panel support member 644 rests on and is supported by the corresponding runner 604, 608, 612, 616. The placement of the panel support member 644 may be carried out with an upward vertical movement of the panel support member 644 and then downward onto the hooks 636, 664. This can be performed prior to or during the positioning of a ceiling panel 108 within an opening 124 in the ceiling grid system 600. The ceiling panel 108 can then be adjusted or maneuvered slightly so that it rests on the horizontal flanges 652 of the associated panel support member 644.

In contrast, to remove a panel support member 644 from an opening 124 within the ceiling grid system 600 of FIGS. 32-37, all that is required is for someone to move the panel support member 644 in an upward vertical direction such that the panel support member 644 is no longer held by the hooks 636, 664. This movement of the panel support members 644 can be performed by someone from below the ceiling grid system 600 in accordance with embodiments of the present invention. As such, this will allow for the relatively quick and easy removal of a ceiling panel 108 from within an opening 124 of the ceiling grid system 600 and without damaging the ceiling panel as in prior art ceiling grid systems. Further, the embodiment of the ceiling grid system 600 of FIGS. 32-37 can be considered to be a linear movement embodiment due to the upward or downward linear vertical movement of the panel support member 644 with respect to the runners 604, 608, 612, 616 during installation and removal, as described hereinabove.

Various embodiments of the ceiling grid system 100, 300, 400, 500, 600 of the present invention have been described hereinabove as having a rectilinear shape and with standard size openings 124 to accommodate standard size ceiling panels 108 (e.g., two feet by two feet, two feet by four feet, etc.). However, oftentimes the room in which the suspended or drop ceiling will be installed is of a size in which the ceiling panels 108 must have a size that is non-standard. As such, to accommodate this situation, the ceiling grid system 100, 300, 400, 500, 600 must also have the various runners and panel support members be of a certain size. It should be apparent to one of ordinary skill in the art in light of the teachings herein how to properly size the various runners and panel support members to achieve the benefits of the various embodiments of the present invention.

Also, oftentimes the room in which the suspended or drop ceiling will be installed is not of a square or rectangular shape. That is, not all of the walls in the room are at right angles to each other. Instead, at least one of the walls is at an angle other than a right angle (e.g., an acute or obtuse angle) to two other adjacent and adjoining walls. As such, to accommodate this situation, the ceiling panels 108 must have a size that is non-standard. Also, the ceiling grid system 100, 300, 400, 500, 600 must also have certain ones of the various runners and panel support members be of a certain size and be angled as well. Thus, it may be necessary to utilize L-shaped brackets and/or other structural devices within the ceiling grid system 100, 300, 400, 500, 600 of embodiments of the present invention to properly account for the non-right-angled wall(s) in the room. It should be apparent to one of ordinary skill in the art in light of the teachings herein how to properly size the various runners and panel support members and how to implement the L-shaped brackets and/or other structural devices to achieve the benefits of the various embodiments of the present invention.

The terminology used herein is for the purpose of describing particular embodiments of the invention only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the invention is provided in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that the exemplary embodiments may include only some of the described exemplary aspects. Accordingly, the invention it not to be seen as limited by the foregoing description but is only limited by the scope of the appended claims.

The invention claimed is:

1. A ceiling grid system for use as part of a suspended ceiling having a plurality of ceiling panels, the ceiling grid system being configured to hold each one of the ceiling panels in a predetermined position within the suspended ceiling when the suspended ceiling is installed in a physical space such as a room, the ceiling grid system comprising:

a plurality of main runners configured to attach to a support structure in the physical space;

a plurality of cross-runners oriented transverse to the plurality of main runners thereby forming a two-dimensional array having a plurality of openings and being disposed in a horizontal plane in the physical space, each one of the openings defining each one of the predetermined positions within the suspended ceiling in which a corresponding ceiling panel is disposed, the main runners and the cross-runners configured to attach to each other and to be fixed in the horizontal plane in the physical space; and a plurality of panel support members, each one of the panel support members connected with a predetermined one of the main runners or a predetermined one of the cross-runners, each one of the panel support members configured to support one of the ceiling panels;

wherein after assembly of the ceiling grid system, each one of the panel support members is movable vertically in a linear manner with respect to the predetermined one of the main runners or the predetermined one of the cross-runners to facilitate the installation or removal of one of the ceiling panels with respect to its predetermined position within the suspended ceiling, and wherein each one of the panel support members that is movable vertically in a linear manner is connected by a periodic interlocking protrusion and hole connection with a predetermined one of the main runners or with a predetermined one of the cross-runners.

2. The ceiling grid system of claim 1, wherein each one of the panel support members is movable vertically in a linear manner with respect to the predetermined one of the main runners or the predetermined one of the cross-runners between two positions, a first one of the two positions being a panel support position in which each one of the panel support members supports one of the ceiling panels, and a second one of the two positions being a panel non-support position in which each one of the panel support members does not support one of the ceiling panels.

3. The ceiling grid system of claim 1, wherein the periodic interlocking protrusion and hole connection comprises a hook or a hole on each one of the panel support members and an opposing hole or a hook on the predetermined one of the main runners or the predetermined one of the cross-runners.

4. The ceiling grid system of claim 1, wherein the periodic interlocking protrusion and hole connection comprises each one of the panel support members having a protrusion that connects with a receiving area on the predetermined one of main runners or the predetermined one of the cross-runners.

5. The ceiling grid system of claim 1, wherein at least one of the openings has four sides that define a square or rectangular opening, a first two of the sides comprising two opposed main runners and second two of the sides comprising two opposed cross-runners, at least one of the four sides includes one of the panel support members connected with one of the main runners or one of the cross-runners.

6. The ceiling grid system of claim 5, wherein at least two of the sides each includes one of the panel support members connected with one of the main runners or one of the cross-runners.

7. The ceiling grid system of claim 6, wherein a first one of the at least two sides includes one of the panel support members connected with one of the main runners, and wherein a second one of the at least two sides includes one of the panel support members connected with one of the cross-runners.

8. The ceiling grid system of claim 7, wherein the first one of the at least two sides and the second one of the at least two sides are adjacent to each other and at an angle to each other.

9. The ceiling grid system of claim 7, wherein at least two of the sides each includes one of the panel support members connected with each one of two of the main runners or each one of two of the cross-runners.

10. The ceiling grid system of claim 9, wherein the first one of the at least two sides and the second one of the at least two sides are opposite to each other.

11. The ceiling grid system of claim 1, wherein each one of the plurality of main runners includes a flange that is oriented horizontally in a plane in which a bottom surface of each one of the ceiling panels is oriented horizontally in, wherein each one of the plurality of cross-runners includes a flange that is oriented horizontally in the plane in which a bottom surface of each one of the ceiling panels is oriented horizontally in, and wherein the flanges of the main runners and the flanges of the cross-runners are configured to stiffen the corresponding main runners and the corresponding cross-runners.

12. The ceiling grid system of claim 1, wherein each one of the plurality of main runners includes a flange that is oriented horizontally in a plane that is located above a plane in which a bottom surface of each one of the ceiling panels is oriented horizontally in, wherein each one of the plurality of cross-runners includes a flange that is oriented horizontally in the plane that is located above the plane in which a bottom surface of each one of the ceiling panels is oriented horizontally in, and wherein the flanges of the main runners and the flanges of the cross-runners are configured to stiffen the corresponding main runners and the corresponding cross-runners.

* * * * *